US005932404A

United States Patent [19]

Chen et al.

[11] Patent Number: 5,932,404

[45] **Date of Patent: *Aug. 3, 1999**

[54] SILVER HALIDE PHOTOGRAPHIC MATERIAL CONTAINING A POLYMER WITH A PHOTOGRAPHICALLY USEFUL GROUP WHICH IS RENDERED NON-DIFFUSIBLE BY CROSS-LINKING

[75] Inventors: Tienteh Chen, Penfield; Hwei-ling Yau, Rochester; Dorothy T. Java, Fairport, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/768,691

[22] Filed: Dec. 18, 1996

[51] Int. Cl.[6] ..... G03C 1/047; G03C 1/053; G03C 1/30; G03C 7/327

[52] U.S. Cl. ..... 430/512; 430/213; 430/517; 430/520; 430/521; 430/522; 430/551; 430/548; 430/559; 430/566; 430/609; 430/621; 430/622; 430/623; 430/626; 430/627; 430/629; 430/630; 430/628; 430/642; 430/598

[58] Field of Search ..... 430/213, 548, 430/621, 622, 623, 628, 630, 642, 512, 551, 559, 566, 598, 609, 517, 522, 520, 521, 629, 626, 627

[56] References Cited

U.S. PATENT DOCUMENTS

| | | | |
|---|---|---|---|
| 2,360,289 | 10/1944 | Thomas | 430/546 |
| 2,533,514 | 12/1950 | Sawdey et al. | 430/546 |
| 2,801,170 | 7/1957 | Vittum et al. | 430/546 |
| 3,625,694 | 12/1971 | Cohen et al. | 430/213 |
| 3,859,096 | 1/1975 | Burness et al. | 430/213 |
| 3,893,860 | 7/1975 | Sutton et al. | 96/114.1 |
| 3,926,436 | 12/1975 | Monbaliu et al. | 430/548 |
| 4,215,195 | 7/1980 | Ponticello et al. | 430/496 |
| 4,367,282 | 1/1983 | Yagihara et al. | 430/548 |
| 4,397,943 | 8/1983 | Ishiguro et al. | 430/609 |
| 4,450,224 | 5/1984 | Klein et al. | 430/213 |
| 4,594,308 | 6/1986 | Nakamura et al. | 430/213 |
| 4,663,272 | 5/1987 | Nakamura | 430/548 |
| 4,766,052 | 8/1988 | Nakamura et al. | 430/213 |
| 4,774,162 | 9/1988 | Shibata et al. | 430/213 |

FOREIGN PATENT DOCUMENTS

| | | |
|---|---|---|
| 51-59943 | 5/1976 | Japan . |
| 142524 | 11/1981 | Japan . |
| 58-27139 | 2/1983 | Japan . |

*Primary Examiner*—Richard L. Schilling
*Attorney, Agent, or Firm*—Carl F. Ruoff

[57] ABSTRACT

The present invention is a silver halide photographic material including at least one layer which contains; a polymer comprising as constituent components thereof a repeating unit having a photographically useful group and at least one repeating unit having an imidazole group; and a compound having at least one functional group which reacts with an imidazole group and at least one other functional group capable of reacting with an imidazole group and a primary amine group, the amount of the compound being sufficient to insure adequate fixation of said polymer.

25 Claims, No Drawings

SILVER HALIDE PHOTOGRAPHIC MATERIAL CONTAINING A POLYMER WITH A PHOTOGRAPHICALLY USEFUL GROUP WHICH IS RENDERED NON-DIFFUSIBLE BY CROSS-LINKING

FIELD OF THE INVENTION

The present invention relates to photographic materials, and, in particular, to silver halide photographic materials containing at least one polymer containing a photographically useful group, and which is rendered non-diffusive by crosslinking with gelatin using a compound having imidazole functional groups.

BACKGROUND OF THE INVENTION

Each layer of a silver halide photographic material contains, in general, various kinds of photographic additives, such as coupler, ultra-violet absorbent, anti-oxidant, stabilizer, color-stain inhibitor, anti-fogging agent, dye, etc.; and various methods have heretofore been proposed for fixation of specific photographic additives in a specific layer comprising gelatin or a hydrophilic binder.

One prior art method is disclosed, for example, in U.S. Pat. Nos. 2,322,029, 2,360,289, 2,533,514 and 2,801,170, where a hydrophobic coupler having an oil-soluble group and a photographically useful group is dissolved in a solvent having a high boiling point. The resulting solution is dispersed in a hydrophilic polymer solution to obtain a coupler dispersion, which is coated on a photographic support. Another prior art method is disclosed, for example, in Japanese Patent Application (OPI) No. 59943/76 (The term "OPI" as used herein refers to a published unexamined Japanese Patent Application.), where a hydrophobic coupler having an oil-soluble group and a photographically useful group is dissolved in a water-compatible organic solvent. An aqueous polymer latex is gradually added to the resulting solution and admixed therewith to incorporate the hydrophobic coupler in the latex particles, and the mixture obtained is dispersed in a hydrophilic polymer and coated on a photographic support.

However, these prior art methods include some troublesome defects as mentioned below. The former method requires an emulsification step requiring a large amount of energy, and the coupler or other additive is often deteriorated during the emulsification step. In the latter method, the amount of the hydrophobic coupler incorporated in the latex particles must inevitably be limited in order to prevent the aggregation of the latex particles.

In addition to the above prior art methods, other methods are known, as disclosed, e.g., in *Research Disclosure*, No. 190, pp. 65–66 (1980), U.S. Pat. Nos. 3,926,436 and 4,397,943, and German Patent No. 1,547,863, where coupler, ultra-violet absorbent and stabilizer are added, each in the form of a water-soluble polymer, to a hydrophilic polymer binder, and the solution obtained is coated on a photographic support. However, this method is also defective in that the water-soluble polymers are not rendered sufficiently non-diffusive and are apt to flow out into the developer during processing. In order to provide non-diffusiveness to a polymer, water-soluble polymers have been developed, having a reactive group such as vinylsulfone group, active ester group, active methylene group, primary amino group, epoxy group, sulfinate group, etc. together with a photographically useful group, the reactive group being able to be cross-linked with gelatin directly or via a hardening agent, for example, as described in Research Disclosure, No. 17825 (1979), U.S. Pat. Nos. 4,663,272, 4,215,195, 3,859,096 and 3,625,694 and Japanese Patent Application (OPI) Nos. 27139/83 and 142524/81.

However, the photographically useful group-containing water-soluble reactive polymer does not have sufficient reactivity with gelatin or a hardening agent, and it is difficult to provide complete non-diffusiveness to the polymer. For example, in the case of a water-soluble polymer which has a photographically useful group comprising a coupler residue capable of forming a dye by coupling with an oxidation product of an aromatic primary amine developing agent, if the polymer is not sufficiently non-diffusive, color stain is apt to occur, and the polymer often flows out during development treatment, resulting in decrease of the density of the formed images. In the case of a water soluble polymer having an residue derived from a reductive color stain-inhibitor as the photographically useful group, if the non-diffusiveness of the polymer is insufficient, this results in a decrease of the density of the formed images.

In addition, conventional reactive groups such as vinylsulfones, active esters, active methylenes and epoxys are per se hydrophobic. Accordingly, if the polymers themselves containing such hydrophobic groups are to be made water-soluble, it is necessary to copolymerize them with a substantial amount of hydrophilic monomer, in addition to a monomer having a reactive group or a photographically useful group. Under this situation, the amount of the monomer having a reactive group or a photographically useful group must be limited. However, if the ratio of the reactive group-containing monomer is made small, sufficient non-diffusiveness cannot be attained; and if the ratio of the photographically useful group-containing monomer is made small, sufficient photographically useful characteristics cannot be attained. These have been troublesome problems.

The present invention provides a solution to the above described problems by providing a novel method for fixation (i.e. attainment of non-diffusiveness) of a compound having a photographically useful group in a layer of a photographic element.

Another object of the present invention is to provide a silver halide photographic material having improved photographic characteristics, by fixing a photographically useful group-containing polymer in a specific layer of a photographic element.

SUMMARY OF THE INVENTION

The present invention is a silver halide photographic material comprising at least one layer which contains; a polymer comprising as constituent components thereof a repeating unit having a photographically useful group and at least one repeating unit having an imidazole group; and a compound having at least one functional group which reacts with an imidazole group and at least one other functional group capable of reacting with an imidazole group and a primary amine group, the amount of the compound being sufficient to insure adequate fixation of said polymer.

DETAILED DESCRIPTION OF THE INVENTION

"Photographically useful group" as used herein refers to a substituent derived from photographic compounds which may be used in silver halide photographic materials, including photographic dyes, development inhibitors, development accelerators, couplers, competing couplers, development inhibitor-releasing compounds (DIR compounds), developing agents, development auxiliary bleaching inhibitors, bleaching accelerators, bleaching accelerator-releasing compounds (BAR compounds), silver halide solvents, silver complexing agents, fogging agents, anti-fogging agents, stabilizers, chemical sensitizers, spectral sensitizers, desensitizers, ultra-violet absorbents, antioxidants, development accelerator-releasing compounds, as well as precursors thereof.

Preferred examples of photographically useful groups containing monomer units which may be used in the present invention include those represented by formula (A)

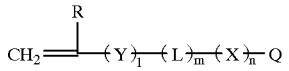

wherein

R is hydrogen atom or an alkyl group having from 1 to 6 carbon atoms;

Y is

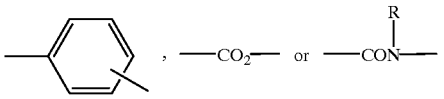

wherein R has the same meaning as above;

L is a divalent bonding group having from 1 to 12 carbon atoms;

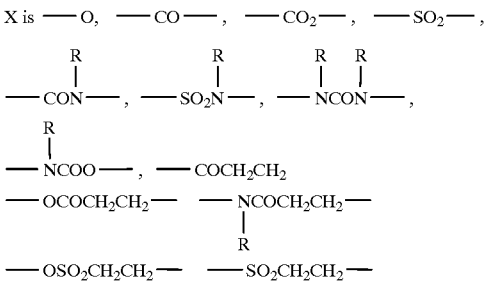

wherein R has the same meaning as above; Q is a photographically useful group; and l, m, and n are each independently 0 or 1. Preferred embodiments of the photographically useful group containing monomers of formula (A) are explained in greater detail below.

R represents a hydrogen atom or an alkyl group having from 1 to 6 carbon atoms such as methyl group, ethyl group, n-propyl group, iso-propyl group, n-butyl group, tert-butyl group, iso-butyl group, sec-butyl group, n-amyl group, tert-amyl group, or n-hexyl group; and is especially preferably a hydrogen atom, a methyl group or an ethyl group.

Y represents

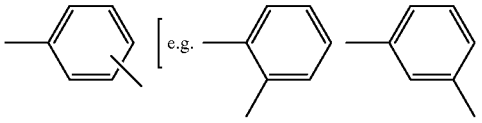

-continued

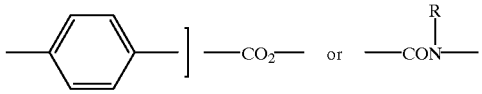

R is selected from the group as mentioned above; for example,

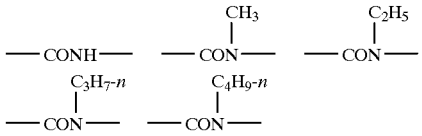

and in particular, Y is especially preferably

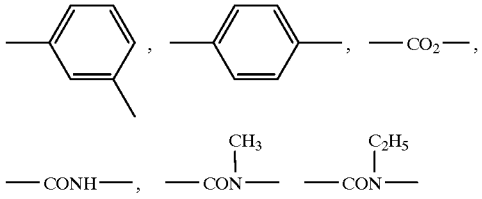

L represents a divalent bonding group having from 1 to 12 carbon atoms, for example, an alkylene group such as methylene group, ethylene group, methylmethylene group, dimethylmethylene group, trimethylene group, tetramethylene group, pentamethylene group, hexamethylene group, octamethylene group, or decamethylene group; or an arylene group such as o-phenylene group, m-phenylene group, p-phenylene group, or naphthylene group; or

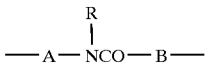

(in which R has the same meaning as above, and A and B represent an alkylene group having from 1 to 10 carbon atoms or an arylene group having from 6 to 10 carbon atoms), such as $—CH_2NHCOCH_2—$ $—CH_2NHCOCH_2CH_2—$ $—CH_2CH_2NHCOCH_2—$ $—CH_2CH_2CH_2NHCOCH_2CH_2—$

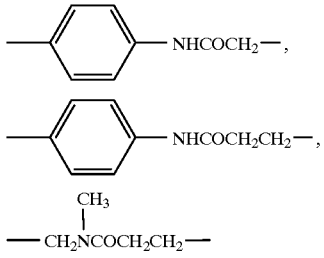

or $—A—CO_2—B—$(in which R, A, and B have the same meanings as above), such as $—CH_2OCOCH_2—$, $—CH_2OCOCH_2CH_2—$ $—CH_2CH_2OCOCH_2—$,

—$CH_2CH_2OCOCH_2CH_2$—,

—$CH_2CH_2CH_2OCOCH_2CH_2$—,

A part of the hydrogen atoms in said alkylene group and arylene group may, optionally, be substituted by an aryl group (such as a phenyl group, or a tolyl group), a nitro group, a hydroxyl group, a cyano group, an alkoxy group (such as a methoxy group), an aryloxy group (such as a phenoxy group), an alkylcarbonyloxy group (such as an acetoxy group), an arylcarbonyloxy group (such as a benzoyloxy group), an alkylcarbonylamino group (such as an acetylamino group), an arylcarbonylamino group (such as a benzoylamino group), a carbamoyl group, an alkylcarbamoyl group (such as a methylcarbamoyl group or ethylcarbamoyl group), a dialkylcarbamoyl group (such as a dimethylcarbamoyl group), an arylcarbamoyl group (such as a phenylcarbamoyl group), an alkylsulfonyl group (such as a methylsulfonyl group), an arylsulfonyl group (such as a phenylsulfonyl group), an alkylsulfonamido group (such as a methanesulfonamido group), an arylsulfonamido group (such as a phenylsulfonamido group), a sulfamoyl group, an alkylsulfamoyl group (such as an ethylsulfamoyl group), a dialkylsulfamoyl group (such as a dimethylsulfamoyl group), an arylsulfamoyl group, carboxyl group, an alkoxycarbonyl group (such as methoxycarbonyl group), a halogen atom (such as a fluorine atom, chlorine atom, bromine atom), etc.

L is especially preferably a methylene group, ethylene group, methylmethylene group, dimethylmethylene group, trimethylene group, tetramethylene group, pentamethylene group, m-phenylene group, p-phenylene group, —$CH_2NHCOCH_2$—, —$CH_2NHCOCH_2CH_2$—, —$CH_2OCOCH_2CH_2$—, or —$CH_2CH_2OCOCH_2CH_2$—

X represents

Imz-1

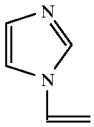

Imz-2

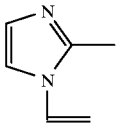

Imz-3

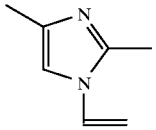

-continued

Imz-4

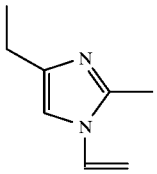

Imz-5

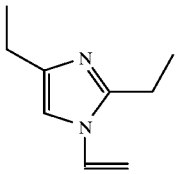

Imz-6

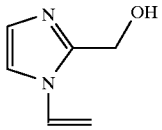

Imz-7

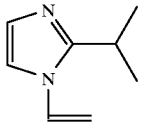

Imz-8

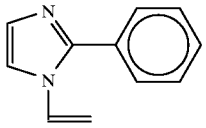

Imz-9

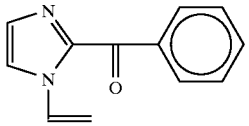

Imz-10

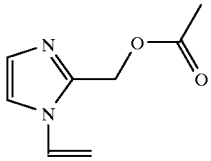

Imz-11

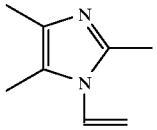

-continued

Imz-12

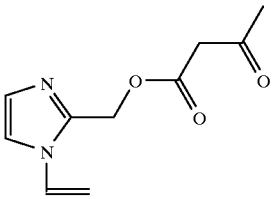

Imz-13

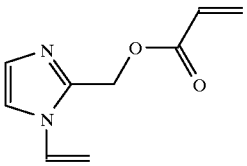

Imz-14

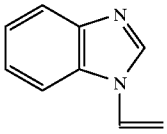

Imz-15

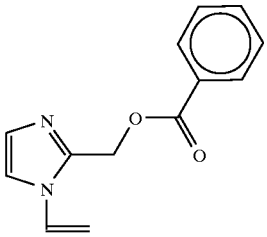

Imz-16

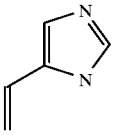

Imz-17

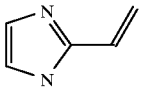

Imz-18

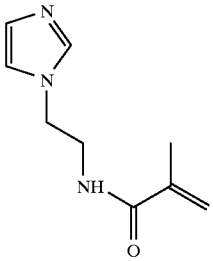

-continued

Imz-19

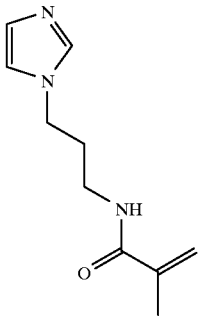

Imz-20

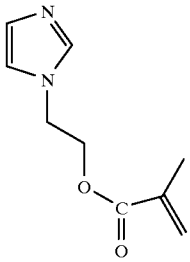

Imz-21

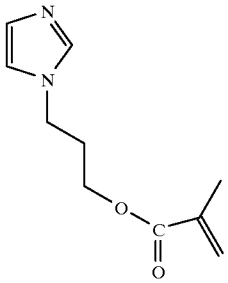

and

Imz-22

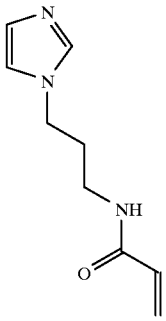

R has the same meaning as above.

Q represents a photographically useful group. For example, Q represents a coupler group capable of forming a dye by coupling with an aromatic primary amine developing agent. As for a cyan coupler group, a phenol-type group of the following formula (I)-1 or a naphthol-type group of the following formula (I)-2 is preferred. The asterisk mark hereinafter shows the position of the bond to X.

(I)-1

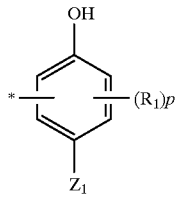

(I)-2

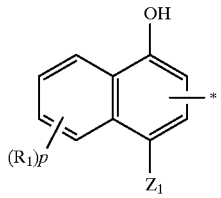

In said formulae (I)-1 and (I)-2, $R_1$ represents an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group or an arylureido group; p is an integer of 0 to 3, and q is an integer of 0 to 4.

$Z_1$ represents hydrogen atom, a halogen atom, sulfo group, an acyloxy group, an alkoxy group, an aryloxy group, a heterocyclic oxy group, an alkylthio group, an arylthio group or a heterocyclic thio group. Groups recited for $R_1$ and $Z_1$ may, optionally, be substituted. Examples of substituents thereon include an aryl group (such as phenyl group), nitro group, hydroxy group, cyano group, sulfo group, an alkoxy group (such as methoxy group), an aryloxy group (such as phenoxy group), an acyloxy group (such as acetoxy group), an acylamino group (such as acetylamino group), an alkylsulfonamido group (such as methanesulfonamido group), an alkylsulfamoyl group (such as methylsulfamoyl group), a halogen atom (such as Cl, Br, F) carboxyl group, an alkylcarbamoyl group (such as methylcarbamoyl group), an alkoxycarbonyl group (such as methoxycarbonyl group), an alkylsulfonyl group (such as methylsulfonyl group), an alkylthio group (such as β-carboxyethylthio group), etc. In the case that the group is substituted by two or more substituents, these may be same or different.

As for a magenta coupler group, pyrazolone-type, pyrazolotriazole-type, and imidazopyrazole-type groups of the following formulae (I)-3 through (I)-14 are preferred.

(I)-3

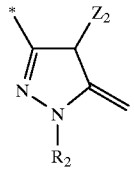

-continued (I)-4

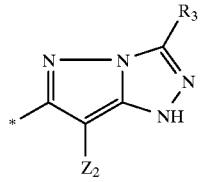

(I)-5

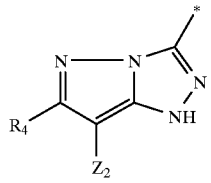

(I)-6

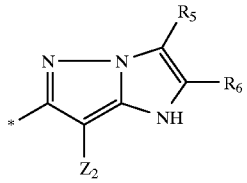

(I)-7

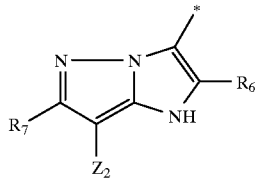

(I)-8

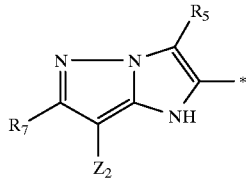

(I)-9

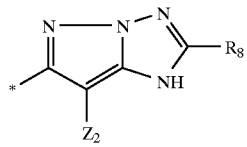

(I)-10

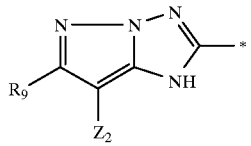

-continued (I)-11

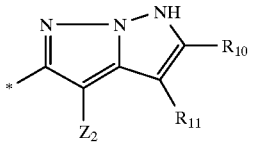

(I)-12

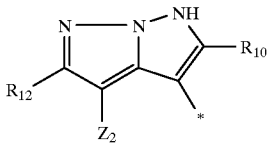

(I)-13

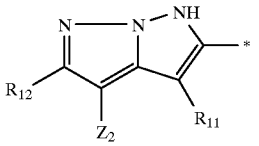

(I)-14

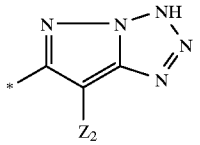

$R_2$ represents a conventional substituent which is well known as a substituent on I-position of a 2-pyrazolinone coupler, for example, an alkyl group, a substituted alkyl group (such as a halo-alkyl group, e.g., fluoroalkyl, or a cyano-alkyl group, a benzyl-alkyl group), an aryl group or a substituted aryl group (examples of substituents thereon is an alkyl group such as a methyl group or ethyl group), an alkoxy group (such as a methoxy group or ethoxy group), an aryloxy group (such as a phenyloxy group), an alkoxycarbonyl group (such as a methoxycarbonyl group), an acylamino group (such as an acetylamino group), a carbamoyl group, an alkylcarbamoyl group (such as a methylcarbamoyl group or ethylcarbamoyl group), a dialkylcarbmoyl group (such as a dimethylcarbamoyl group), an arylcarbamoyl group (such as a phenylcarbamoyl group), an alkylsulfonyl group (such as a methylsulfonyl group), an aryisulfonyl group (such as a phenylsulfonyl group), an alkylsulfonamido group (such as a methanesulfonamido group), an arylsulfonamido group (such as a phenylsulfonamido group), a sulfamoyl group, an alkylsulfamoyl group (such as an ethylsulfamoyl group), a dialkylsulfamoyl group (such as a dimethylsulfamoyl group), an arylsulfamoyl group, an alkylthio group (such as a methylthio group), an arylthio group (such as a phenylthio group), cyano group, nitro group, a halogen atom (such as a fulorine atom, chlorine atom, bromine atom), etc. In case said group is substituted by two or more of said substituents, these may be same or different. Especially preferably, substituents are halogen atom, alkyl group, alkoxy group, alkoxycarbonyl group and cyano group.

$R_3$, $R_4$, $R_5$, $R_6$, $R_7$, $R_8$, $R_9$, $R_{10}$, $R_{11}$ and $R_{12}$ are each independently a hydrogen atom or hydroxyl group, or each represents an unsubstituted or substituted alkyl group (preferably having from 1 to 20 carbon atoms, such as a methyl group, a propyl group, a t-butyl group, a trifluoromethyl group, a tridecyl group), an aryl group (preferably having from 6 to 20 carbon atoms, such as a phenol group, a 4-t-butylphenyl group, a 2,4-di-t-amylphenyl group, a 4-methoxyphenyl group), a heterocyclic group (such as a 2-furyl group, a 2-thienyl group, a 2-pyrimidinyl group, a 2-benzthiazolyl group), an alkylamino group (preferably having from 1 to 20 carbon atoms, such as a methylamino group, a diethylamino group, a t-butylamino group), an acylamino group (preferably having from 2 to 20 carbon atoms, such as an acetylamino group, a propylamido group, a benzamido group), an anilino group (such as phenylamino group, 2-chloroanilino group), an alkoxycarbonyl group (preferably having from 2 to 20 carbon atoms, such as a methoxycarbonyl groupbutoxycarbonyl group, a 2-ethylhexyoxycarbonyl group), an alkylcarbonyl group (preferrably having from 2 to 20 carbon atoms, such as an acetyl grop, a butylcarbonyl group, a cyclohexylcarbonyl group), an arylcarbonyl group (preferably having from 7 to 20 carbon atoms, such as a benzoyl group, a 4-t-butylbenzoyl group), an alkylthio group (preferably having from 1 to 20 carbon atoms, such as a methylthio group, an octylthio group, a 2-phenoxyethylthio group), an arylthio group (preferably having from 6 to 20 carbon atoms, such as a phenylthio group, a 2-buioxy-5-t-octylphenylthio group), a carbamoyl group (preferably having from 1 to 20 carbon atoms, such as an N-ethylcarbamoyl group, an N,N-dibutylcarbamoyl group, an N-methyl-N-butyicarbamoyl group), a sulfamoyl group (preferably $NH_2SO_2$- and a group having from 1 to 20 carbon atoms, such as an N-ethylsulfamoyl group, an N,N-diethylsulfamoyl group, an N,N-dipropyisulfamoyl group) or an alkyl sulfonamido group (preferably having from 1 to 20 carbon atoms, such as a methanesulfonamido group), an arylsulfonamido group (preferably having from 6 to 20 carbon atoms, such as benzenesulfonamido group, a p-toluenesulfonamido group).

$Z_2$ represents a hydrogen atom, a halogen atom, or a split-off group which is bonded at a coupling position via an oxygen, nitrogen, or sulfur atom. In the case $Z_2$ is bonded at a coupling position via an oxygen, nitrogen, or sulfur atom, the atom is bonded with an alkyl group, an aryl group, an alkylsulfonyl group, an arylsulfonyl group, an alkylcarbonyl group, an arylcarbonyl group or a heterocyclic ring residue. In addition, in case $Z_2$ is bonded at a coupling position via nitrogen atom, this may form, including the nitrogen atom, a 5- or 6-membered ring (such as an imidazolyl group, pyrazolyl group, triazolyl group, or tetrazolyl group).

As for a yellow dye forming coupler group, an acylacetanilide-type group of formula (I)-15 and benzoylacetanilide-type groups of formulae (I)-16 and (I)-17 are shown below.

(I)-15

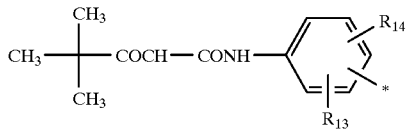

(I)-16

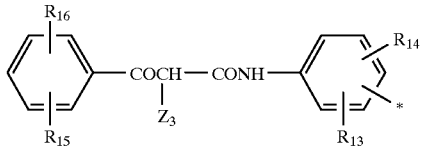

-continued (I)-17

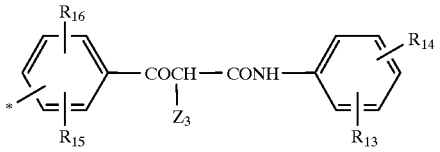

$R_{13}$, $R_{14}$, $R_{15}$ and $R_{16}$ each independently represents a hydrogen atom or a substituent which is conventional and well known in a yellow coupler group, for example, an alkyl group, an alkenyl group, an alkoxy group, an alkoxycarbonyl group, a halogen atom, an alkoxycarbamoyl group, an aliphatic amido group, an alkylsulfamoyl group, an alkylfonamido group, an alkylureido group, an alkyl-substituted succinmido group, an aryloxy group, an aryloxycarbonyl group, an arylcarbamoyl group, an arylamido group, an arylsulfamoyl group, an aryisulfonamido group, an arylureido group, carboxyl group, sulfo group, nitro group, cyano group or thiocyano group.

$Z_3$ represents a hydrogen atom, —$OR_{17}$ (in which $R_{17}$ represents an aryl group, a substituted aryl group or a heterocyclic group), or

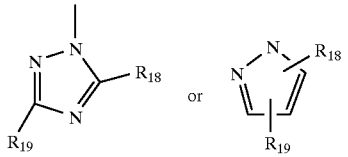

wherein $R_{18}$ and $R_{19}$ each independently represents a hydrogen atom, a halogen atom, a carboxylic acid ester residue, an amino group, an alkyl group, an alkylthio group, an alkoxy group, an alkylsulfonyl group, an alkylsulfinyl group, a carboxylic acid group, a sulfonic acid group, a substituted or unsubstituted phenyl group, or a heterocyclic ring, or

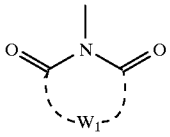

wherein;

$W_1$ is an atomic group necessary for forming a 4 to 7 membered ring together with

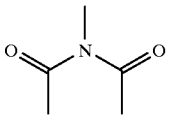

Especially preferred among the foregoing are

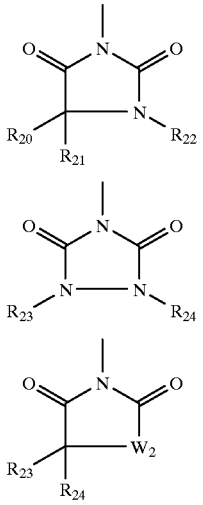

wherein;

$R_{20}$, $R_{21}$, and $R_{22}$ each independently represents a hydrogen atom, an alkyl group, an aryl group, an aralkyl group, or an acyl group; $W_2$ represents an oxygen atom or a sulfur atom; $R_{23}$ and $R_{24}$ each independently represents a hydrogen atom, an alkyl group, an aryl group, an alkoxy group, an aryloxy group, or hydroxy group.

Preferred examples of monomers of the above described formula (A), which have as a photographically useful group a coupler group capable of forming a dye by coupling with an aromatic primary amine developer, are set forth below.

Examples of Cyan-Forming Couplers

C-1

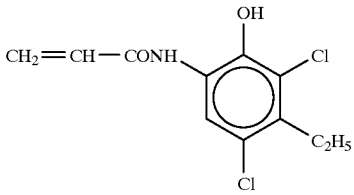

C-2

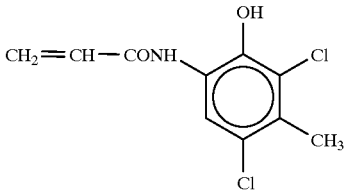

C-3

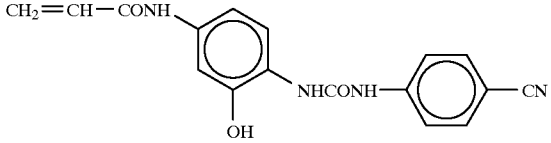

-continued
C-4
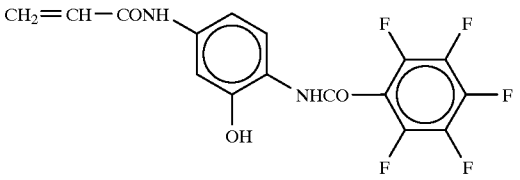
C-5
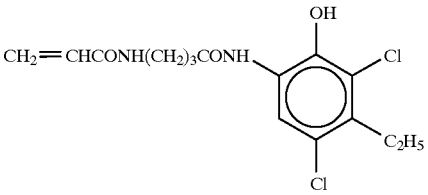
C-6
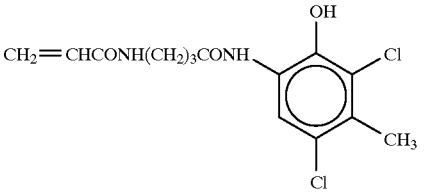
C-7
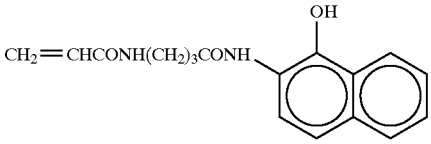
C-8
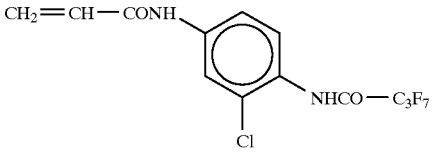
Examples of Yellow-Forming Couplers
y-1
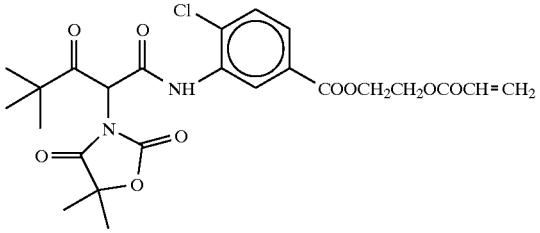
y-2
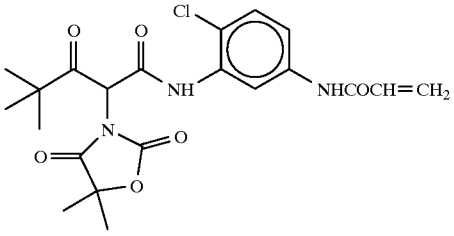
-continued
y-3
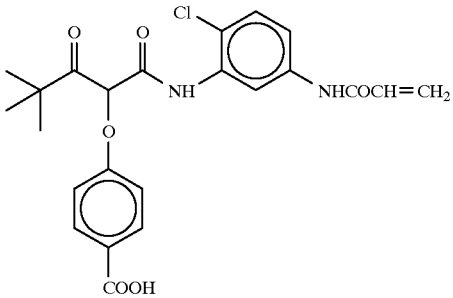
y-4
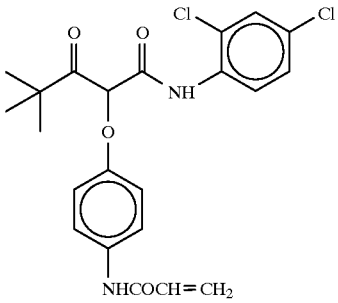
y-5
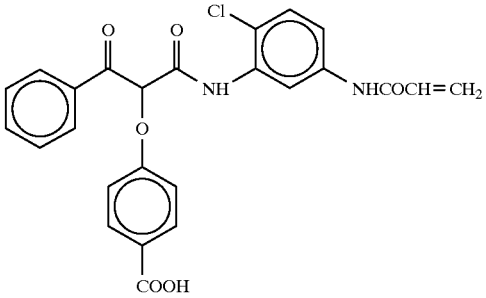
y-6
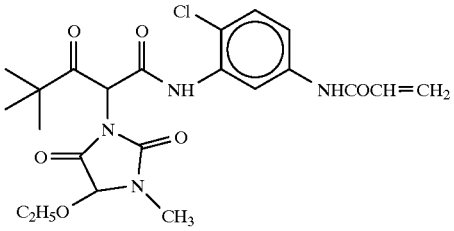
y-7
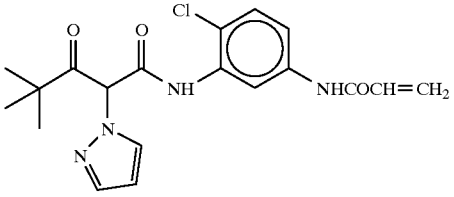

-continued
y-8
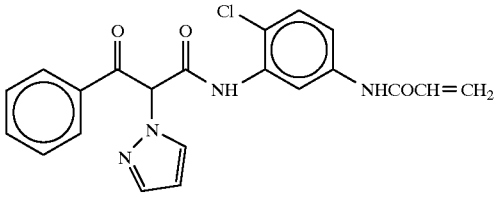
y-9
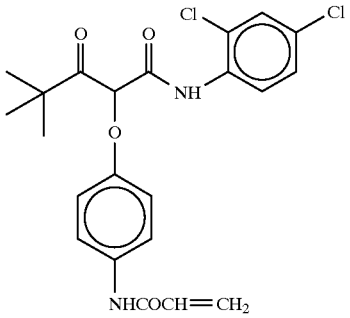
Examples of Magenta-Forming Couplers
m-1
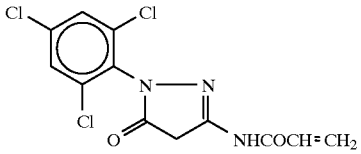
m-2
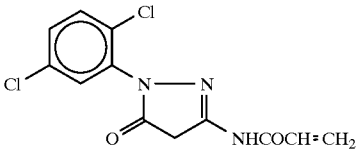
m-3
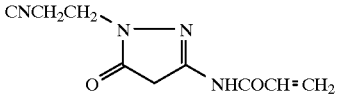
m-4
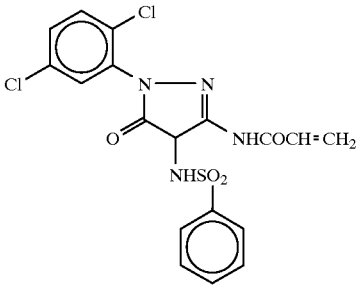
-continued
m-5
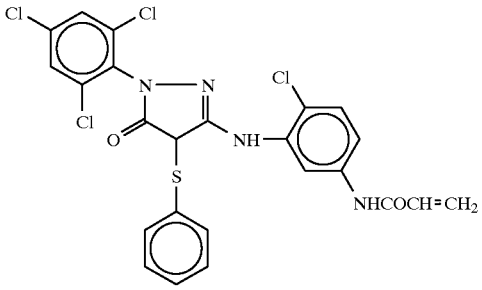
m-6
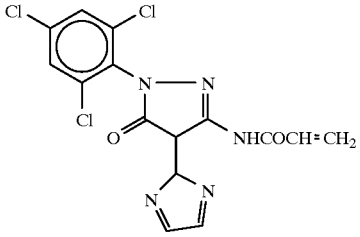
m-7
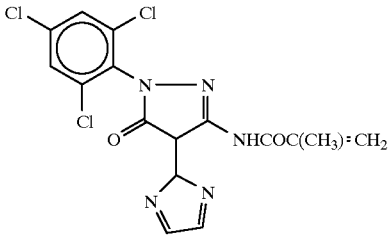
m-8
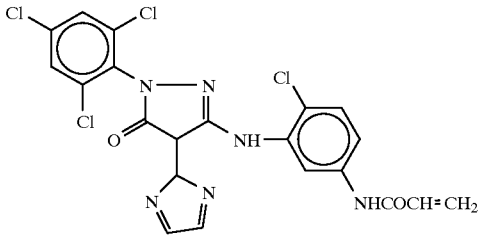
m-9
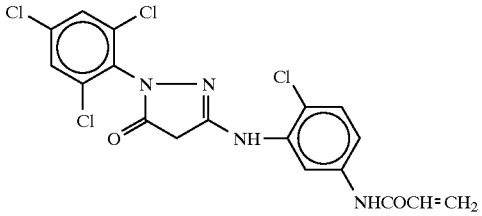
m-10
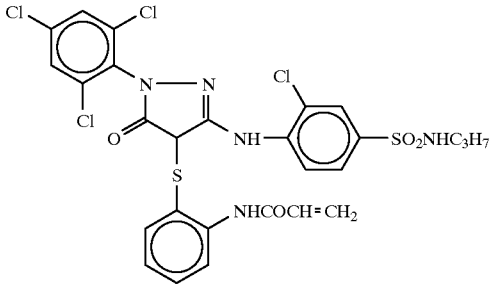

-continued m-11

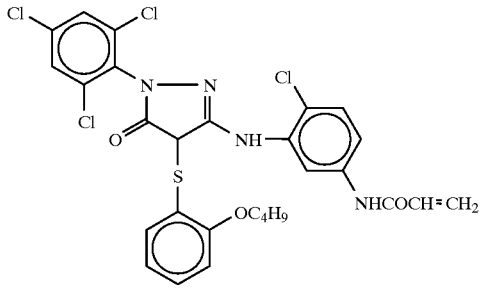

m-12

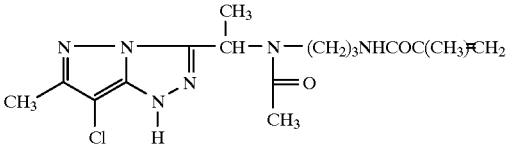

m-13

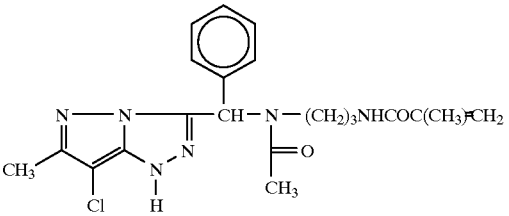

m-14

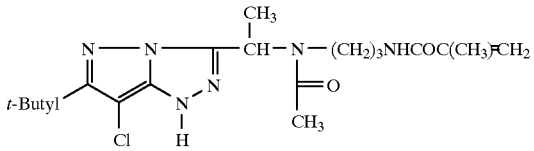

m-15

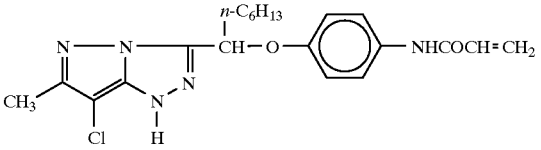

m-16

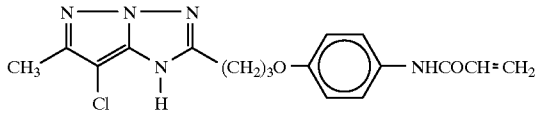

m-17

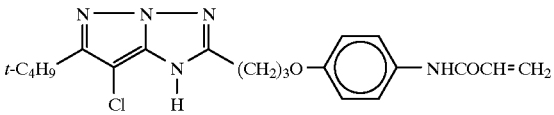

m-18

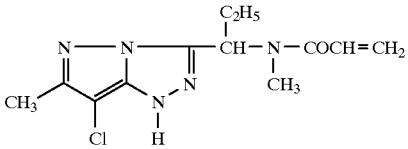

-continued m-19

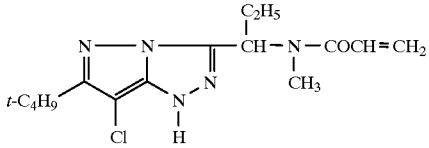

m-20

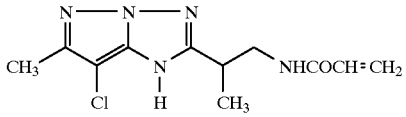

m-21

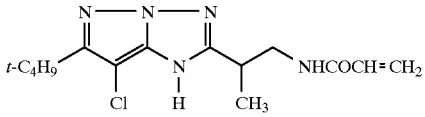

Q in the above-mentioned formula (A) may represent a group derived from a development inhibitor, and examples thereof are described in U.S. Pat. Nos. 3,227,554, 3,384,657, 3,615,506, 3,617,291 and 3,733,201, and British Patent No. 1,450,479. Preferred development inhibitor residues are represented by the following formulae (II)-1 through (II)-6, which are described in Japanese Patent Application (OPI) No. 145135/79.

(II)-1

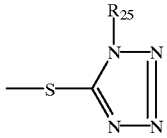

(II)-2

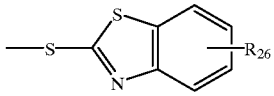

(II)-3

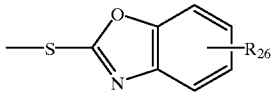

(II)-4

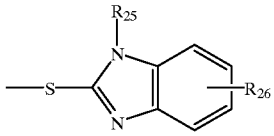

(II)-5

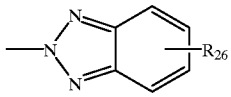

(II)-6

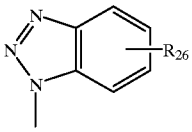

In the above formulae, $R_{25}$ represents a hydrogen atom, an alkyl group containing from 1 to 6 carbon atoms, a phenyl group or a substituted phenyl group; and $R_{26}$ represents hydrogen atom, a halogen atom, an alkyl group containing from 1 to 4 carbon atoms, or a nitro group.

Preferred examples of monomers having a photographically useful group of a development inhibitor residue which are included in the scope of said formula (A) are set forth below.

DI-1

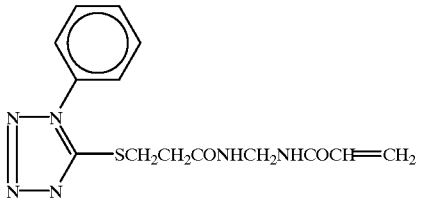

DI-2

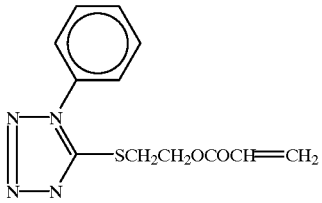

DI-3

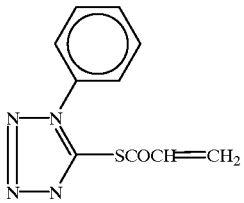

DI-4

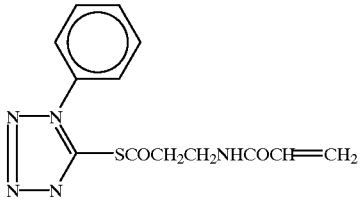

DI-5

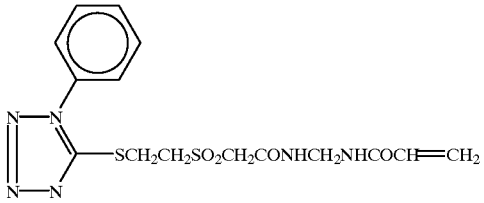

DI-6

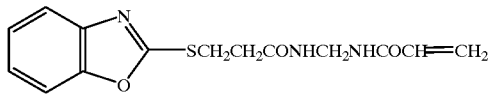

DI-7

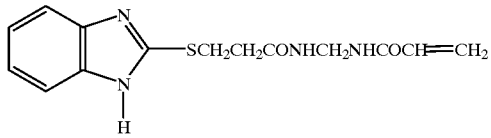

-continued

DI-8

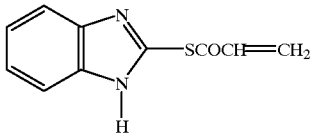

DI-9

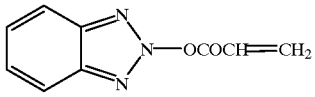

DI-10

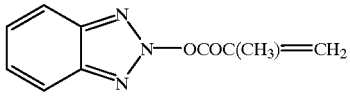

DI-11

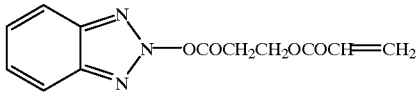

DI-12

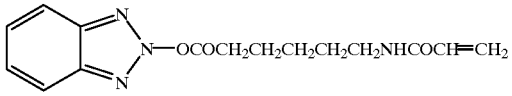

DI-13

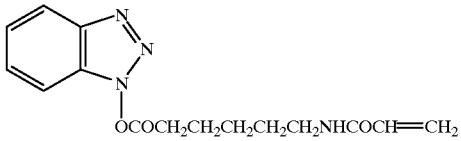

DI-14

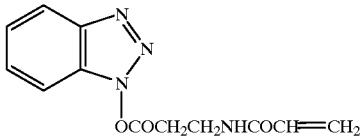

DI-15

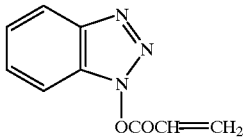

DI-16

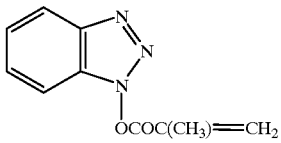

Q in the formula (A) may represent a group derived from a developing agent, and examples thereof are described in U.S. Pat. Nos. 2,193,015, 2,108,243, 2,592,364, 3,656,950, 3,658,525, 2,751,297, 2,289,367, 2,772,282, 2,743,279, 2,753,265 and 2,304,953. Preferred developing agents capable of yielding group Q are aminophenols, phenylenediamines, hydroquinones, and pyrazolidones as described in Japanese Patent Application (OPI) No. 145135/79, and residues of the following formulae (III)-1 through (III)-6 are especially preferred.

(III)-1

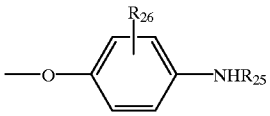

(III)-2

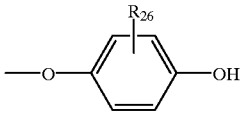

(III)-3

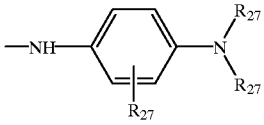

(III)-4

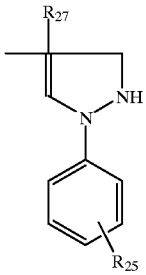

(III)-5

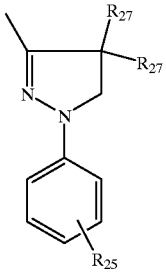

(III)-6

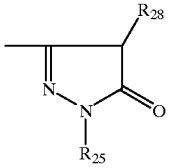

In the above formulae, $R_{25}$ and $R_{26}$ have the same meanings as set forth above; $R_{27}$ represents a hydrogen atom, an alkyl group containing 1 to 4 carbon atoms, a hydroxyalkyl group containing from 1 to 4 carbon atoms (such as a hydroxymethyl group or hydroxyethyl group) or a sulfoalkyl group containing from 1 to 4 carbon atoms; and $R_{28}$ represents an alkyl group containing from 1 to 20 carbon atoms or an aryl group containing 6 to 20 carbon atoms.

Preferred examples of monomers having as a photographically useful group a developing agent group, which are included in the scope of said formula (A) are set forth below.

Dev-1

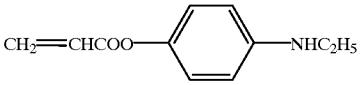

Dev-2

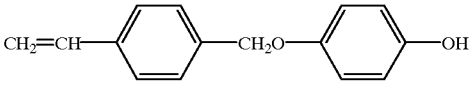

Dev-3

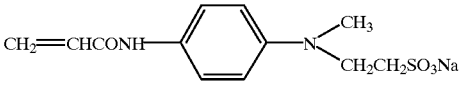

Dev-4

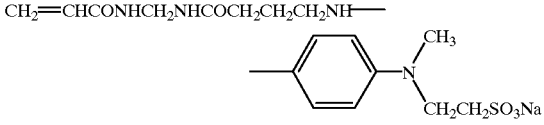

Dev-5

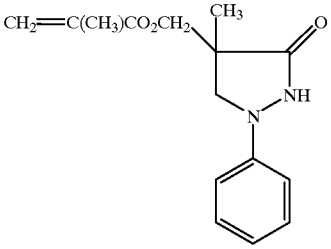

Dev-6

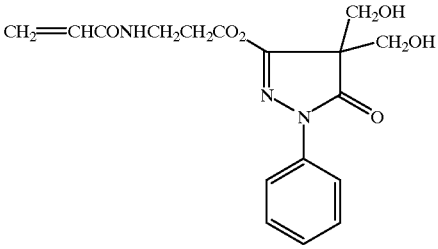

Dev-7

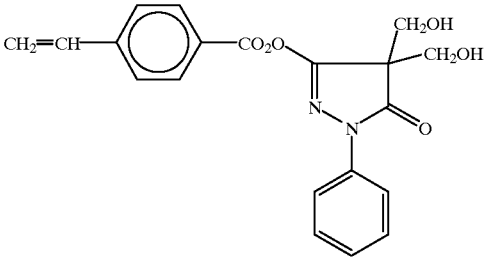

Dev-8

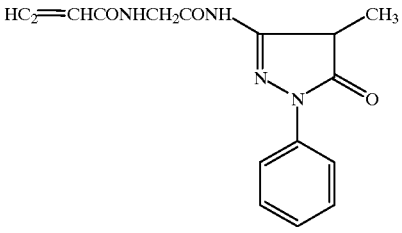

-continued

Dev-9

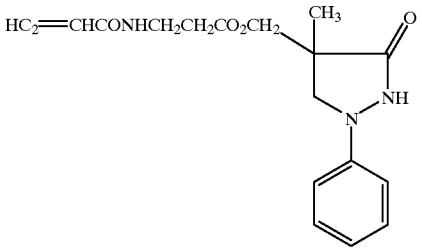

Q in the formula (A) may represent a group derived from a bleaching inhibitor, and examples thereof are described in U.S. Pat. Nos. 3,705,801 and 3,715,208 and German Patent OLS No. 2,405,279. Groups of the following formulae (IV)-1 through (IV)-4, which are derived from bleaching inhibitors, are especially preferred, as described in Japanese Patent Application (OPI). No. 145135/79.

(IV)-1

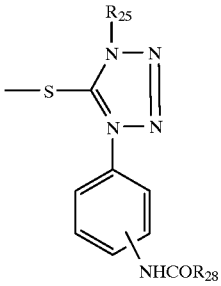

-continued (IV)-2

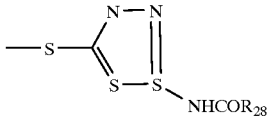

(IV)-3

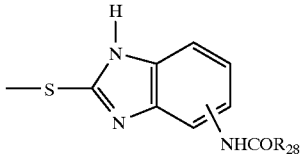

(IV)-4

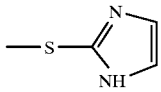

In the above formulae, $R_{28}$ has the same meaning as described above.

Preferred examples examples of monomers having a photographic group of a bleaching inhibitor group which are included in the scope of said formula (A) are set forth below.

BI-1

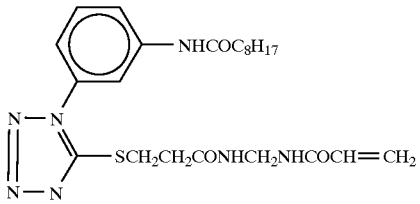

BI-2

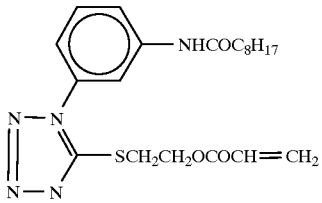

BI-3

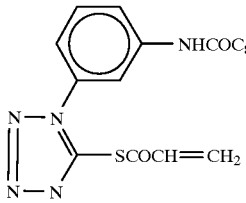

-continued

BI-4

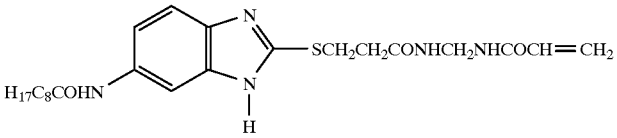

BI-5

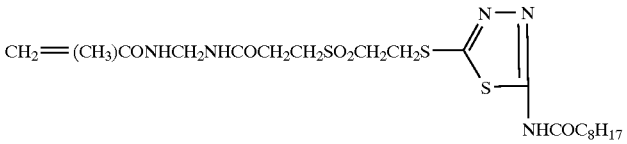

BI-6

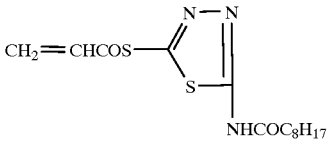

Q in the formula (A) may represent a residue derived from an ultra-violet absorbent, and examples thereof are described in U.S. Pat. Nos. 4,431,726, 4,178,303, and 4,207,253, and Japanese Patent Application (OPI) Nos. 178351/83, 185677/83, 111942/83 and 27139/83. Groups of the following formulae (V)-1 through (V)-8, which are derived from ultra-violet absorbents, are especially preferred.

(V)-1

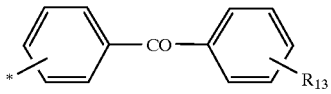

(V)-2

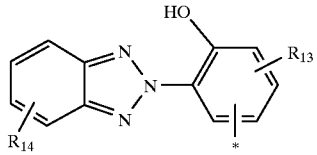

(V)-3

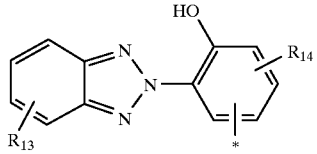

(V)-4

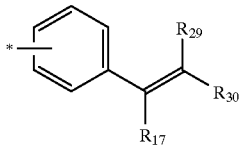

-continued (V)-5

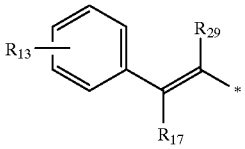

(V)-6

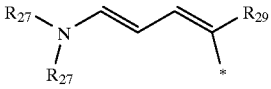

(V)-7

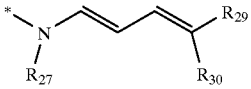

(V)-8

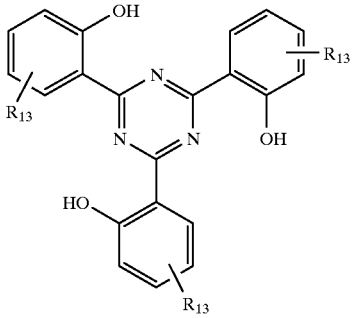

In the above formulae, $R_{13}$, $R_{14}$, $R_{17}$ and $R_{27}$ have the same meanings as described above; $R_{29}$ and $R_{30}$ each independently represents a cyano group, an aryl group (such as phenyl group, tolyl group), an alkyl group (such as a methyl group, ethyl group, butyl group, or hexyl group), an alkoxycarbonyl group (such as an ethoxycarbonyl group or propoxycarbonyl group), an arylsulfonyl group (such as a phenylsulfonyl group), or an alkylsulfonyl group (such as a methylsulfonyl group).

Preferred examples of monomers having as a photographically useful group an ultra-violet absorbent group which are included in the scope of said formula (A) are set forth below.

uv-1

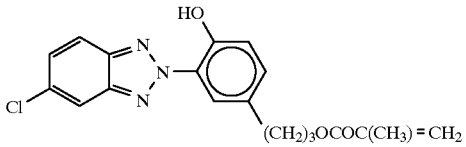

uv-2)

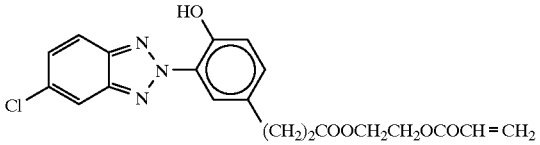

uv-3

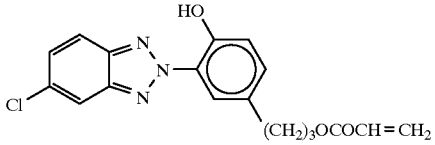

uv-4

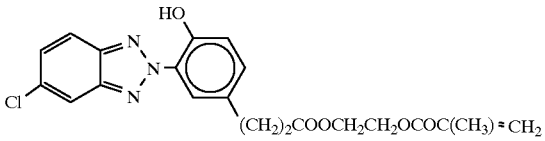

uv-5

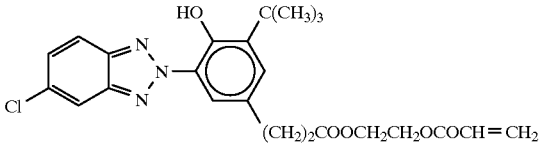

uv-6

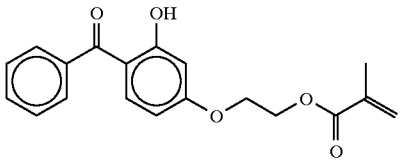

uv-7

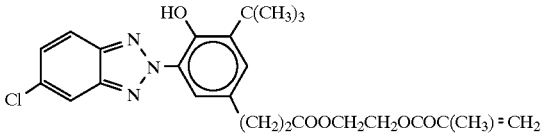

uv-8

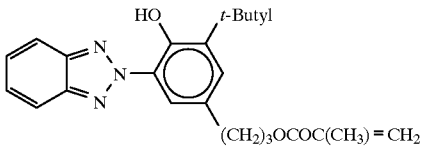

-continued uv-9

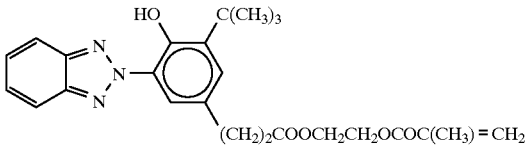

uv-10

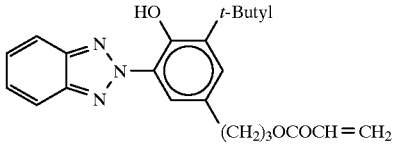

uv-11

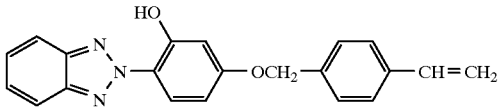

uv-12

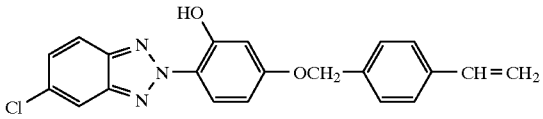

uv-13

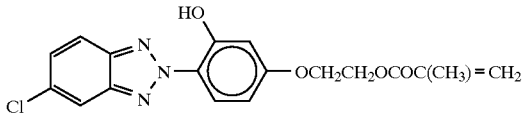

uv-14

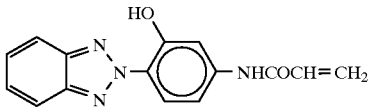

uv-15

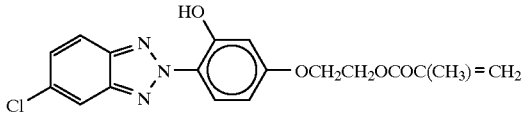

uv-16

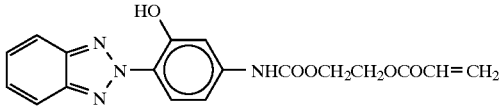

uv-17

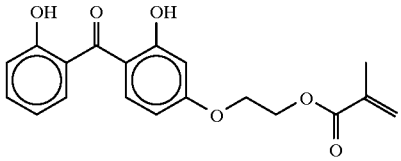

uv-18

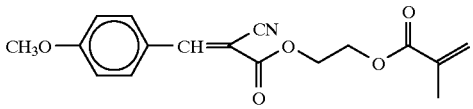

uv-19

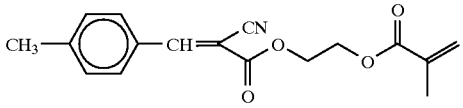

-continued uv-20

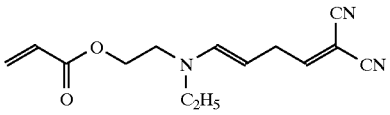

uv-21

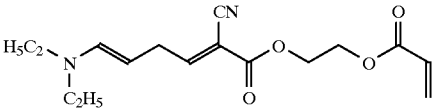

uv-22

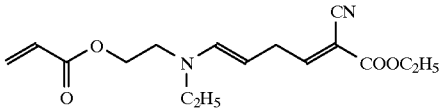

uv-23

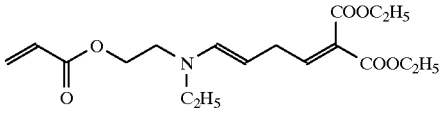

uv-24

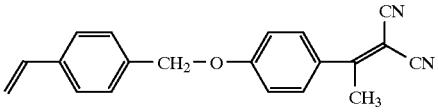

uv-25

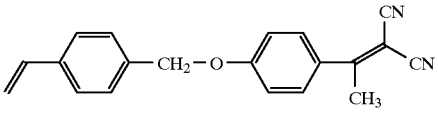

uv-26

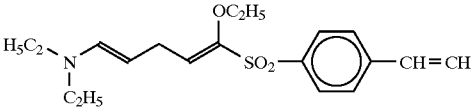

uv-27

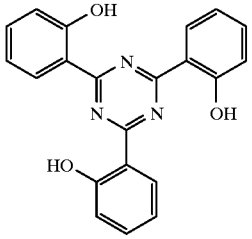

uv-28

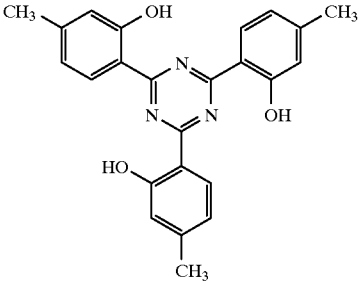

Q in the formula (A) may represent a group derived from a dye, and examples thereof are described in Japanese Patent Application (OPI) No. 145135/79.

Preferred dyes are triarylmethane-type, azo-type, anthraquinone-type, merocyanine-type, oxonole-type, arylidene-type and styryl-type dyes. Preferred examples of monomers having as a photographically useful group a dye group which are included in the scope of said formula (A) are set forth below.

D-1

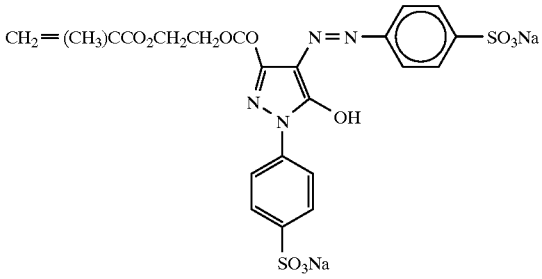

D-2

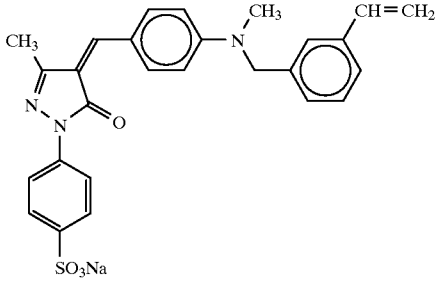

D-3

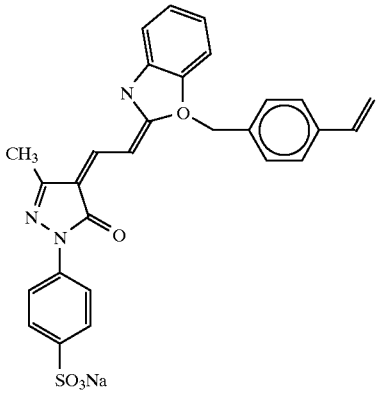

Examples of imidazole group containing monomers which may be used in the present invention include those represented by the formula (B)

(B)

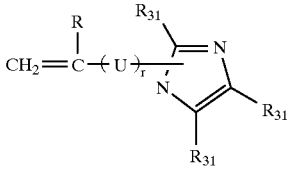

wherein R has the same meaning as defined in the case of the above-described formula (A); U represents a divalent bonding group containing from 1 to 20 carbon atoms and r is 0 or 1. R is preferably a hydrogen atom, methyl group, or ethyl group. U represents a divalent bonding group having 1 to 20 carbon atoms, for example, an alkylene group (such as a methylene group, ethylene group, trimethylene group, or hexamethylene group), a phenylene group(such as an o-phenylene group, p-phenylene group, or m-phenylene group), an arylenealkylene group, —$CO_2$—, —$CO_2$—$R_{30}$— (wherein $R_{30}$ represents an alkylene group, a phenylene group or an arylenealkylene group), —CONH—$R_{30}$— (in which $R_{30}$ has the same meaning as above), or —CONR—$R_{30}$— (in which R and $R_{30}$ have the same meaning as described above); $R_{31}$ represents hydrogen, or primary, secondary and tertiary alkyl groups, an aryl group, an arylalkyl group, and the derivatives of the groups described above, such as hydroxy groups, carbonyl groups, amine groups, ester groups, or halogen groups.

Preferred examples of formula (B) are set of forth below.

Imz-1

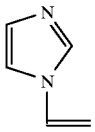

Imz-2

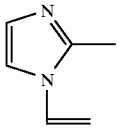

Imz-3

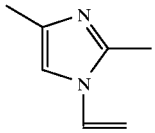

Imz-4

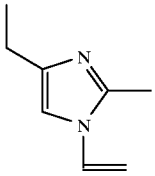

Imz-5

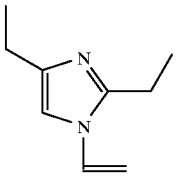

Imz-6

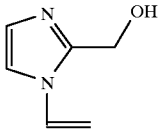

Imz-7

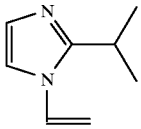

Imz-8

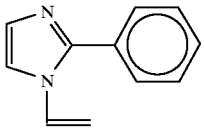

-continued

Imz-9

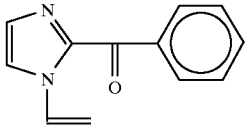

Imz-10

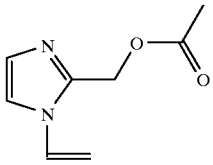

Imz-11

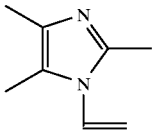

Imz-12

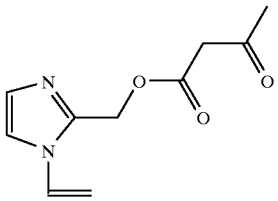

Imz-13

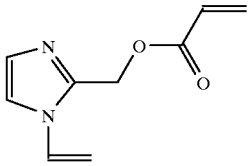

Imz-14

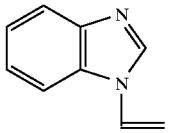

Imz-15

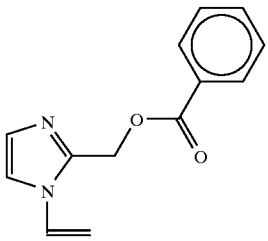

Imz-16

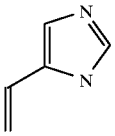

Imz-17

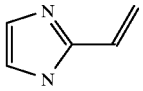

-continued

Imz-18

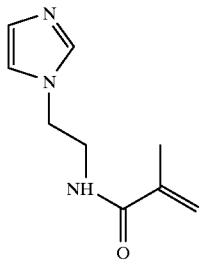

Imz-19

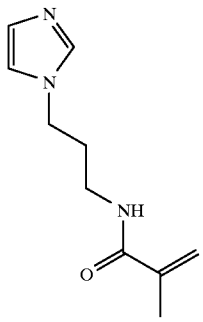

Imz-20

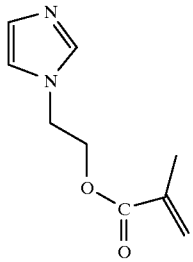

Imz-21

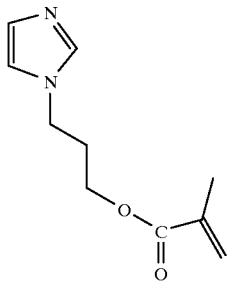

Imz-22

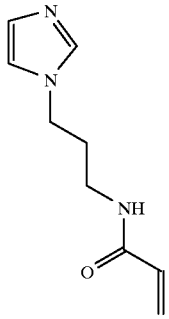

Photographic polymers which may be used in the present invention may additionally contain other monomers in addition to the photographically useful group-containing monomers of the above-described formula (A) and the imidazole group containing monomers of the above-described formula (B).

Preferred examples of monomers useful for forming said additional monomers are sodium vinyl sulfonate, 3-sulfopropylmethacrylate (hydrogen, sodium or potassium salt), 3-sulfopropylacrylate (hydrogen, sodium or potassium salt), 2-sulfoethylmethacrylate (hydrogen, sodium or potassium salt), 2-sulfoethylacrylate (hydrogen, sodium or potassium salt), 2-acrylamido-2-methyl-1-propanesulfonic acid (hydrogen, sodium or potassium salt), 1-vinyl-2-pyrrolidinone, acrylic acid, methacrylic acid, vinylbenzenesulfonate (hydrogen, sodium or potassium salt), vinylbenzenesulfinate (hydrogen, sodium or potassium salt), and vinyl phosphoric acid.

In the photographic polymers of the present invention, the content of the photographically useful group containing monomer is preferably from 20 to 98 wt. % and especially preferably from 30 to 90 wt. %. The content of the imidazole group containing monomer is preferably from 2 to 50 wt. % and more preferably from 4 to 40 wt. %. The content of other additional monomer(s) is preferably 70 wt. % or less.

The polymer containing photographically useful groups of the present invention preferably have a molecular weight of from $5\times10^3$ to $1\times10^7$. If the molecular weight is too small, the polymer is apt to easily move, but if the molecular weight is too large, the polymer is difficult to coat on a photographic support. The preferred molecular weight of the polymers falls within the range of from $1\times10^4$ to $2\times10^6$.

Preferred examples of the polymers which may be used in the present invention are set forth below.

| | Polymer Composition | Weight Ratio | Polymer I.D. |
|---|---|---|---|
| Polymeric UV Absorber | UV-9/Am/Imz-1/NA-AMPS | 50/37.5/2.5/10 | PUV-1 |
| | UV-9/Am/Imz-1/NA-AMPS | 50/35/5/10 | PUV-2 |
| | UV-9/Am/Imz-2/NA-AMPS | 50/35/5/10 | PUV-3 |
| | UV-9/NVP/Imz-1/NA-AMPS | 50/35/5/10 | PUV-4 |
| | UV-9/Aa/Imz-1/Spmk | 50/37.5/2.5/10 | PUV-5 |
| | UV-9/Maa/Imz-1/Spmk | 50/37.5/2.5/10 | PUV-6 |
| | UV-9/Am/Imz-1/Spmk | 50/37.5/2.5/10 | PUV-7 |
| | UV-9/Am/Imz-1-Sss | 50/37.5/2.5/10 | PUV-8 |
| | UV-9/Hema/Imz-1/Sss | 50/37.5/2.5/10 | PUV-9 |
| | UV-9/NVP/Imz-1/Sss | 50/37.5/2.5/10 | PUV-10 |
| | UV-1/Am/Imz-1/NA-AMPS | 50/30/5/15 | PUV-11 |
| | UV-1/Am/Imz-2/NA-AMPS | 50/30/5/15 | PUV-12 |
| | UV-1/Am/Imz-18/Spmk | 50/30/5/15 | PUV-13 |
| | UV-2/Am/Imz-1/NA-AMPS | 50/30/5/15 | PUV-14 |
| | UV-3/Am/Imz-1/NA-AMPS | 50/30/5/15 | PUV-15 |
| | UV-5/Am/Imz-1/NA-AMPS | 50/30/5/15 | PUV-16 |
| | UV-8/Am/Imz-1/NA-AMPS | 50/30/5/15 | PUV-17 |
| | UV-13/Am/Imz-1/NA-AMPS | 50/30/5/15 | PUV-18 |
| | UV-2/Am/Imz-18/NA-AMPS | 50/30/5/15 | PUV-19 |
| | UV-1/NVP/Imz- | 50/30/5/15 | PUV-20 |

-continued

| | Polymer Composition | Weight Ratio | Polymer I.D. |
|---|---|---|---|
| | 1/NA-AMPS | | |
| | UV-1/Am/Imz-1/Sss | 50/30/5/15 | PUV-21 |
| | UV-13/Am/Imz-2/NA-AMPS | 50/30/5/15 | PUV-22 |
| | UV-1/Imz-1/NA-AMPS | 60/5/35 | PUV-23 |
| | UV-9/Imz-1/NA-AMPS | 60/5/35 | PUV-24 |
| | UV-1/Am/Imz-1/Sem | 50/30/5/15 | PUV-25 |
| | UV-7/UV-9/Am/Imz-1/NA-AMPS | 25/25/35/5/10 | PUV-26 |
| | UV-18/UV-20/Am/Imz-1/NA-AMPS | 25/25/35/5/10 | PUV-27 |
| | UV-9/Am/Imz-1/NA-AMPS | 50/32.5/2.5/15 | PUV-28 |
| | UV-9/Am/Imz-1/NA-AMPS | 50/25/5/20 | PUV-29 |
| Polymeric Yellow Couplers | Y-1/Am/Imz-1/NA-AMPS | 50/37.5/2.5/10 | PY-1 |
| | Y-1/Am/Imz-1/NA-AMPS | 50/30/5/15 | PY-2 |
| | Y-1/Am/Imz-2/NA-AMPS | 50/30/5/15 | PY-3 |
| | Y-1/NVP/Imz-1/NA-AMPS | 50/30/5/15 | PY-4 |
| | Y-1/Am/Imz-1/Spmk | 50/37.5/2.5/10 | PY-5 |
| | Y-2/Am/Imz-1/NA-AMPS | 50/30/5/15 | PY-6 |
| | Y-2/Am/Imz-2/NA-AMPS | 50/30/5/15 | PY-7 |
| | Y-2/Am/Imz-2/Spmk | 50/30/5/15 | PY-8 |
| | Y-3/Am/Imz-1/NA-AMPS | 50/30/5/15 | PY-9 |
| | Y-3/Am/Imz-1/NA-AMPS | 50/30/5/15 | PY-10 |
| | Y-5/Am/Imz-1/NA-AMPS | 50/30/5/15 | PY-11 |
| | Y-8/Am/Imz-1/NA-AMPS | 50/30/5/15 | PY-12 |
| | Y-4/Am/Imz-1/NA-AMPS | 50/30/5/15 | PY-13 |
| | Y-6/Am/Imz-18/NA-AMPS | 50/30/5/15 | PY-14 |
| | Y-1/Aa/Imz-1/Spmk | 50/37.5/2.5/10 | PY-15 |
| | Y-1/Maa/Imz-1/Spmk | 50/37.5/2.5/10 | PY-16 |
| | Y-1/Am/Imz-1/Spmk | 50/37.5/2.5/10 | PY-17 |
| | Y-1/Am/Imz-1/Sss | 50/37.5/2.5/10 | PY-18 |
| | Y-1/Hema/Imz-1/Sss | 50/37.5/2.5/10 | PY-19 |
| | Y-1/NVP/Imz-1/Sss | 50/37.5/2.5/10 | PY-20 |
| Polymeric Cyan Couplers | CY-1/Am/Imz-1/NA-AMPS | 50/37.5/2.5/10 | PCY-1 |
| | CY-1/Am/Imz-1/NA-AMPS | 50/30/5/15 | PCY-2 |
| | CY-1/Am/Imz-2/NA-AMPS | 50/30/5/15 | PCY-3 |
| | CY-1/NVP/Imz-1/NA-AMPS | 50/30/5/15 | PCY-4 |
| | CY-1/Am/Imz-1/Spmk | 50/37.5/2.5/10 | PCY-5 |
| | CY-2/Am/Imz-1/NA-AMPS | 50/30/5/15 | PCY-6 |
| | CY-2/Am/Imz-2/NA-AMPS | 50/30/5/15 | PCY-7 |
| | CY-2/Am/Imz-2/Spmk | 50/30/5/15 | PCY-8 |
| | CY-3/Am/Imz-1/NA-AMPS | 50/30/5/15 | PCY-9 |
| | CY-3/Am/Imz-1/NA-AMPS | 50/30/5/15 | PCY-10 |
| | CY-5/Am/Imz-1/NA-AMPS | 50/30/5/15 | PCY-11 |
| | CY-8/Am/Imz-1/NA-AMPS | 50/30/5/15 | PCY-12 |
| | CY-7/Am/Imz-1/NA-AMPS | 50/30/5/15 | PCY-13 |
| | CY-6/Am/Imz-18/NA-AMPS | 50/30/5/15 | PCY-14 |
| Polymeric Magenta Couplers | M-7/Am/Imz-1/NA-AMPS | 50/37.5/2.5/10 | PM-1 |
| | M-7/Am/Imz-1/NA-AMPS | 50/30/5/15 | PM-2 |
| | M-7/Am/Imz-2/NA-AMPS | 50/30/5/15 | PM-3 |
| | M-7/NVP/Imz-1/NA-AMPS | 50/30/5/15 | PM-4 |
| | M-7/Am/Imz-1/Spmk | 50/37.5/2.5/10 | PM-5 |
| | M-1/Am/Imz-1/NA-AMPS | 50/30/5/15 | PM-6 |
| | M-5/Am/Imz-2/NA-AMPS | 50/30/5/15 | PM-7 |
| | M-2/Am/Imz-2/Spmk | 50/30/5/15 | PM-8 |
| | M-5/Am/Imz-1/NA-AMPS | 50/30/5/15 | PM-9 |
| | M-3/Am/Imz-1/NA-AMPS | 50/30/5/15 | PM-10 |
| | M-10/Am/Imz-1/NA-AMPS | 50/30/5/15 | PM-11 |
| | M-8/Am/Imz-1/NA-AMPS | 50/30/5/15 | PM-12 |
| | M-7/Am/Imz-1/NA-AMPS | 50/30/5/15 | PM-13 |
| | M-6/Am/Imz-1/NA-AMPS | 50/30/5/15 | PM-14 |
| | M-15/Am/Imz-1/NA-AMPS | 50/37.5/2.5/10 | PM-15 |
| | M-16/Am/Imz-1/NA-AMPS | 50/37.5/2.5/10 | PM-16 |
| | M-17/Am/Imz-1/NA-AMPS | 50/37.5/2.5/10 | PM-17 |
| | M-21/Am/Imz-1/NA-AMPS | 50/37.5/2.5/10 | PM-18 |
| | M-7/Aa/Imz-1/Spmk | 50/37.5/2.5/10 | PUV-5 |
| | M-7/Maa/Imz-1/Spmk | 50/37.5/2.5/10 | PUV-6 |
| | M-7/Am/Imz-18/Spmk | 50/37.5/2.5/10 | PUV-7 |
| | M-7/Am/Imz-2/Sss | 50/37.5/2.5/10 | PUV-8 |
| | M-7/Hema/Imz-1/Sss | 50/37.5/2.5/10 | PM-7 |
| | M-7/NVP/Imz-1/Sss | 50/37.5/2.5/10 | PUV-10 |
| | M-16/Aa/Imz-1/Spmk | 50/37.5/2.5/10 | PUV-5 |
| | M-16/Maa/Imz-1/Spmk | 50/37.5/2.5/10 | PUV-6 |
| | M-16/Am/Imz-2/Spmk | 50/37.5/2.5/10 | PUV-7 |
| | M-16/Am/Imz-18/Sss | 50/37.5/2.5/10 | PUV-8 |
| | M-16/Hema/Imz-1/Sss | 50/37.5/2.5/10 | PUV-9 |
| | M-16/NVP/Imz-1/Sss | 50/37.5/2.5/10 | PUV-10 |
| Polymeric Bleach Inhibitor | BI-1/Am/Imz-1/NA-AMPS | 50/37.5/2.5/10 | PBI-1 |
| | BI-1/Am/Imz-1/NA-AMPS | 50/30/5/15 | PBI-2 |
| | BI-1/Am/Imz-2/NA-AMPS | 50/30/5/15 | PBI-3 |
| | BI-1/NVP/Imz-1/NA-AMPS | 50/30/5/15 | PBI-4 |
| | BI-1/Am/Imz-1/Spmk | 50/37.5/2.5/10 | PBI-5 |
| | BI-2/Am/Imz-1/NA-AMPS | 50/30/5/15 | PBI-6 |
| | BI-2/Am/Imz-2/NA-AMPS | 50/30/5/15 | PBI-7 |
| | BI-2/Am/Imz-2/Spmk | 50/30/5/15 | PBI-8 |
| | BI-3/Am/Imz-1/NA-AMPS | 50/30/5/15 | PBI-9 |
| | BI-3/Am/Imz-1/NA- | 50/30/5/15 | PBI-10 |

-continued

| | Polymer Composition | Weight Ratio | Polymer I.D. |
|---|---|---|---|
| | AMPS | | |
| | BI-5/Am/Imz-1/NA-AMPS | 50/30/5/15 | PBI-11 |
| | BI-4/Am/Imz-1/NA-AMPS | 50/30/5/15 | PBI-12 |
| | BI-6/Am/Imz-1/NA-AMPS | 50/30/5/15 | PBI-13 |
| | BI-6/Am/Imz-18/NA-AMPS | 50/30/5/15 | PBI-14 |
| Polymeric Development Inhibitor | DI-1/Am/Imz-1/NA-AMPS | 50/37.5/2.5/10 | PDI-1 |
| | DI-1/Am/Imz-1/NA-AMPS | 50/30/5/15 | PDI-2 |
| | DI-1/Am/Imz-2/NA-AMPS | 50/30/5/15 | PDI-3 |
| | DI-1/NVP/Imz-1/NA-AMPS | 50/30/5/15 | PDI-4 |
| | DI-1/Am/Imz-1/Spmk | 50/37.5/2.5/10 | PDI-5 |
| | DI-2/Am/Imz-1/NA-AMPS | 50/30/5/15 | PDI-6 |
| | DI-2/Am/Imz-2/NA-AMPS | 50/30/5/15 | PDI-7 |
| | DI-2/Am/Imz-2/Spmk | 50/30/5/15 | PDI-8 |
| | DI-3/Am/Imz-1/NA-AMPS | 50/30/5/15 | PDI-9 |
| | DI-3/Am/Imz-1/NA-AMPS | 50/30/5/15 | PDI-10 |
| | DI-5/Am/Imz-1/NA-AMPS | 50/30/5/15 | PDI-11 |
| | DI-4/Am/Imz-1/NA-AMPS | 50/30/5/15 | PDI-12 |
| | DI-6/Am/Imz-1/NA-AMPS | 50/30/5/15 | PDI-13 |
| | DI-6/Am/Imz-18/NA-AMPS | 50/30/5/15 | PDI-14 |
| | DI-6/Am/Imz-1/NA-AMPS | 50/30/5/15 | PDI-15 |
| | DI-7/Am/Imz-1/NA-AMPS | 50/30/5/15 | PDI-16 |
| | DI-8/Am/Imz-1/NA-AMPS | 50/30/5/15 | PDI-17 |
| | DI-9/Am/Imz-1/NA-AMPS | 50/30/5/15 | PDI-18 |
| | DI-10/Am/Imz-1/NA-AMPS | 50/30/5/15 | PDI-19 |
| | DI-11/Am/Imz-1/NA-AMPS | 50/30/5/15 | PDI-20 |
| | DI-12/Am/Imz-1/NA-AMPS | 50/30/5/15 | PDI-21 |
| | DI-13/Am/Imz-1/NA-AMPS | 50/30/5/15 | PDI-22 |
| | DI-14/Am/Imz-1/NA-AMPS | 50/30/5/15 | PDI-23 |
| | DI-15/Am/Imz-1/NA-AMPS | 50/30/5/15 | PDI-24 |
| | DI-16/Am/Imz-1/NA-AMPS | 50/30/5/15 | PDI-25 |
| Polymeric Dye | Dy-1/Am/Imz-1/NA-AMPS | 50/37.5/2.5/10 | PDY-1 |
| | Dy-1/Am/Imz-1/NA-AMPS | 50/37.5/2.5/10 | PDY-1 |
| | Dy-1/Am/Imz-1/NA-AMPS | 50/37.5/2.5/10 | PDY-1 |

Am represents acrylamide;
NA-AMPS represents acryloamido-2-methyl-propane sulfonic acid, sodium salt available from Lubrizol Corporation;
NVP represents N-vinyl-2-pyrrolidione;
Aa represents acrylic acid;
Maa represents methacrylic acid;
HEMA represents hydroxyethyl methacrylate;
Sss represents sodium styrene sulfonic acid, sodium salt;
Spmk represents sulfopropylmethacrylate, potassium salt.

As compound (2) which is used in the present invention, i.e., a compound having at least one functional group capable of reacting with an imidazole group and at least one other functional group capable of reacting with an imidazole group and a primary amine group, photographic gelatin-hardening agent is preferred.

Preferred photographic gelatin-hardening agents which may be used in the present invention include, for example, an aldehyde (such as formaldehyde, glyoxal, glutaraldehyde), a ketone (such as diacetyl, cyclopentanedione), an N-methylol compound (such as diethylol-urea, methyloldimethylhydantoin), a dioxane derivatives (such as 2,3-dihydroxy-dioxane), an active vinyl compounds (such as 1,3,5-triacrylol-hyxahydro-s-triazine, bis(vinylsulfonyl) methylether, N,N'-ethylenebis (vinylsulfonylacetamide)), an active ester (such as di-N-hydroxysuccinimido-succinate), an active halogen compound (such as 2,4-dichloro-6-hydroxy-s-triazine), a mucohalogenic acid (such as mucochloric acid, mucophenoxychloric acid), an isoxazole, a dialdehydestarch, a 1-chloro-6-hydroxytriazinylated gelatin, a high molecular weight active vinyl compound, a high molecular weight active ester compound, etc. Examples of said hardening agents are described in U.S. Pat. Nos. 1,870,354, 2,726,162, 2,870,013, 2,893,611, 2,992,109, 3,047,394, 3,057,723, 3,103,437, 3,325,287, 3,362,827, 3,490,911, 3,539,644, 4,161,407; British Patent Nos. 676,628, 825,544, and 1,270,578; German Patent Nos. 872,153, 1,090,427, 2,749,260; Japanese Patent Publication No. 7133/59, and Japanese Patent Application (OPI) Nos. 66841/81 and 142524/81.

Among the gelatin-hardening agents, active vinyl compounds, especially vinylsuufonl compounds and presursors thereof, are preferred.

Vinylsulfonyl compounds which may be used in the present invention include those described, e.g., in Japanese Patent Publication No. 13563/74, U.S. Pat. No. 3,539,664, and *Research Disclosure*, RD No. 17458. Preferred vinylsulfonyl compounds and precursors thereof are represented by the following formulae (C) and (D).

$$CH_2{=}CHSO_2{-}A{-}SO_2CH{=}CH_2 \quad (C)$$

$$XCH_2{-}CH_2SO_2{-}A{-}SO_2CH_2{-}CH_2X \quad (D)$$

In the above formulae, A represents a divalent bonding group; and X represents a mono-valent organic group which may be removed from the formula (D) in the form of a compound of HX to form a compound of the formula (C).

A is, for example, an alkylene group, preferably having from 1 to 10 carbon atoms, or a phenylene group, the alkylene group may optionally contain an ether bond or an amido bond in the chain thereof. The alkylene and phenylene groups may optionally be substituted with, for example, an alkyl group (preferably having from 1 to 5 carbon atoms, a halogen atom (e.g., chlorine atom), or a hydroxy group. In particular, A is preferably an alkylene group, and especially preferably $-CH_2-$, $-CH_2OCH_2-$, $-CH_2CH(OH)CH_2-$, or $-CH_2CONH-(CH_2)_n NHCOCH_2-$, in which n is 2 or 3.

X is preferably a halogen atom, an acyloxy group (preferably, alkylcarbonyloxy group having from 2 to 4 carbon atoms, and an arylcarbonyloxy group having from 7 to 11 carbon atoms) or a sulfonyloxy group (preferably, an alkylsulfonyloxy group having from 1 to 6 carbon atoms and an arylsulfonyloxy group having from 6 to 10 carbon atoms), and especially preferably a chlorine atom, acetoxy group, or methanesulfonyloxy group.

Examples of preferred gelatin hardening agents are given below. Other known hardening agents may also be used in the present invention.

$CH_2{=}CH{-}SO_2{-}CH_2OCH_2{-}SO_2CH{=}CH_2$ $CH_2{=}CH{-}SO_2{-}CH_2{-}SO_2CH{=}CH_2$ $CH_2{=}CH{-}SO_2{-}CH_2CH(OH)CH_2{-}SO_2CH{=}CH_2$ $CH_2{=}CH{-}SO_2{-}CH_2CONHCH_2CH_2NHCOCH_2{-}SO_2CH{=}CH_2$ $CH_2{=}CH{-}SO_2{-}CH_2CONHCH_2CH_2CH_2NHCOCH_2{-}SO_2CH{=}CH_2$ $CH_2{=}CH{-}SO_2{-}CH_2CHCH_2{-}SO_2CH{=}CH_2$ $CH_2{=}CH{-}SO_2{-}CH_2CHCH_2{-}SO_2CH{=}CH_2$ $-(CH_2{-}CH)_{67}-$ ($CONHC(CH_3)_2CH_2SO_3Na$)

$-(CH_2{-}CH)_{33}-$ ($CONHCH_2NHCOCH_2CH_2SO_2CH{=}CH_2$)

The amount of compound (2) used in the present invention may be widely varied, in accordance with the use and the object of the photographic materials to be formed. In general, the amount is from 0.05 to 10 molar times, and preferably from 0.1 to 2.0 molar times, the amount of the imidazole group contained in the polymer (1) used in the present invention. When the amount of compound (2) is too small the fixation of the polymer is not sufficient, and when the amount of compound (2) is too large the layer of the photographic material becomes difficult to swell, which prevents impregnation of a processing solution to the layer. Upon deciding the amount of compound (2) the amount which is used for hardening gelatin should also be taken into account.

Polymer (1) and compound (2) used in the present invention are in general incorporated in the same layer; or alternatively incorporated in different photographic layers. In the latter case, one compound diffuses into a layer containing the other compound, and as a result, the two compounds come to exist in the same layer. Incorporation of the compounds in different layers is applied in the case that if both compounds used in the present invention are added in one coating solution, the viscosity of the coating solution is too high and the coating solution is difficult to handle.

Some examples to illustrate the synthesis of polymers which may be used in the present invention are described below.

Polymer Synthesis I(BB5679-16)

In a 250 mL 3-neck R.B. flask equipped with a mechanical stirrer, nitrogen innet, and a condenser was charged with 11.35 g of UV-10, 8.51 g of acrylamide, 0.584 g of 2-vinylimidazole, 2.27 g of acryloamido-2-methylpropanesulfonic acid, and 98.5 mL of DMF (N,N-dimethyl formamide). The system was purged with nitrogen for 30 minutes and immersed in a constant temperature bath at 80° C. 0.23 g of 2,2'-azobisisobutyronitrile was added to initiate the polymerization. The polymerization was continued for 6 hours. The polymer solution was cooled, transferred to a dialysis bag (MW cutoff 12,000–14,000), and dialyzed overnight. The polymer solution was then diafilterred and concentrated. The % solids was 12.62%. Combustion analysis confirmed the composition. The final pH was adjusted to 5.5 prior to the evaluation.

Polymer Synthesis II(BB5679-35)

In a 250 mL 3-neck R.B. flask equipped with a mechanical stirrer, nitrogen innet, and a condenser was charged with 8.6 g of UV-2, 6.45 g of acrylamide, 0.43 g of 2-vinylimidazole, 1.72 g of acryloamido-2-methylpropanesulfonic acid, and 73 mL of DMF. The system was purged with nitrogen for 30 minutes and immersed in a constant temperature bath at 80° C. 0.17 g of 2,2'-azobisisobutyronitrile was added to initiate the polymerization. The polymerization was continued for 6 hours. The polymer solution was cooled, transferred to a dialysis bag (MW cutoff 12,000–14,000), and dialyzed for overnight. The polymer solution was then diafilterred and concentrated. The % solids was 5.26%. Combustion analysis confirmed the composition. The final pH was adjusted to 5.5 prior to the evaluation.

Polymer Synthesis III(BB5679-38)

In a 250 mL 3-neck R.B. flask equipped with a mechanical stirrer, nitrogen innet, and a condenser was charged with 4.86 g of UV-7, 3.645 g of acrylamide, 0.243 g of 2-vinylimidazole, 0.97 g of acryloamido-2-methylpropanesulfonic acid, and 41 mL of DMF. The system was purged with nitrogen for 30 minutes and immersed in a constant temperature bath at 80° C. 0.1 g of 2,2'-azobisisobutyronitrile was added to initiate the polymerization. The polymerization was continued for 6 hours. The polymer solution was cooled, transferred to a dialysis bag (MW cutoff 12,000–14,000), and dialyzed overnight. The polymer solution was then diafilterred and concentrated. The % solids was 5.47%. Combustion analysis confirmed the composition. The final pH was adjusted to 5.5 prior to the evaluation.

Polymer Synthesis III(BB5679-40)

In a 250 mL 3-neck R.B. flask equipped with a mechanical stirrer, nitrogen innet, and a condenser was charged with 4.51 g of UV-9, 3.386 g of acrylamide, 0.226 g of 2-vinylimidazole, 0.90 g of acryloamido-2-methylpropanesulfonic acid, and 38 mL of DMF. The system was purged with nitrogen for 30 minutes and immersed in a constant temperature bath at 80° C. 0.09 g of 2,2'-azobisisobutyronitrile was added to initiate the polymerization. The polymerization was continued for 6 hours. The polymer solution was cooled, transferred to a dialysis bag (MW cutoff 12,000–14,000), and dialyzed overnight. The polymer solution was then diafilterred and concentrated. The % solids was 4.95%. Combustion analysis confirmed the composition. The final pH was adjusted to 5.5 prior to the evaluation.

Polymer Synthesis III(BB5679-60)

In a 250 mL 3-neck R.B. flask equipped with a mechanical stirrer, nitrogen innet, and a condenser was charged with 4.86 g of UV-7, 3.645 g of acrylamide, 0.243 g of 2-vinylimidazole, 0.97 g of acryloamido-2-methylpropanesulfonic acid, and 41 mL of DMF. The system was purged with nitrogen for 30 minutes and immersed in a constant temperature bath at 80° C. 0.10 g of 2,2'-azobisisobutyronitrile was added to initiate the polymerization. The polymerization was continued for 6 hour. The polymer solution was cooled, transferred to a dialysis bag (MW cutoff 12.00–14,000), and dialyzed overnight. The polymer solution was then diafilterred and concentrated. The % solids was 5.73 g %. Combustion analyais confirmed the composition. The final pH was adjusted to 5.5 prior to the evaluation.

Polymer Synthesis IV(BB5679-88)-Polymeric Magenta Coupler 7.2 g of m-15, 0.38 g of Imz-1 were dissolved in 60 mL DMF with slight heating. 12.65 g of acryloamido-2-methylpropanesultonic acid, and 1.5 g of 10% 4,4'-azobic(4-cyanovaleric acid) (in DMF) was dissolved in a mixture of 15 mL water and 15 mL of DMF. Both solutions were simultaneously added over two hours to a 250 mL 3-neck R.B. flask equipped with a mechanical stirrer, nitrogen innet, and a condenser at 80° C. The same amount of initiator was added after two hours and polymerized for two more hours. The mixture was cooled to room temperature. The mixture was poured into water and dialyzed overnight. The polymer solution was then concentrated to 6.13%. Combustion analysis confirmed the composition. The final pH was adjusted to 5.5 prior to the evaluation.

The compounds of the present invention may be incorporated in the same layer in the form of a mixture of two or more compounds. Also, a particular compound may be incorporatod in two or more layers.

The polymer (1) and the compound (2) may be incorporated in any layer of a photographic material, such as, a silver halide emulsion layer, a protective layer, an interlayer, and a subbing layer depending on the aim of use of the polymer.

For introduction of polymer (1) and compound (2) of the present invention into silver halide emulsion layers, water-soluble compounds among may be incorporated in a silver halide emulsion in the form of an aqueous solution thereof; water insoluble compounds may be dispersed in a hydrophilic colloid and the resulting dispersion incorporated in a silver halide emulsion. The polymer (1) and compound (2) may be incorporated separately. The silver halide emulsion thus containing the compounds of the present invention is thereafter coated on a photographic support. In the same manner compounds can be incorporated to other layers. Furthermore, compound (2) may be impregnated to a photographic material as a solution after completion of coating of all layers.

The amount of the polymer (1) used in the present invention is dependent on the property and use of the photographic material formed.

The silver halide photographic materials of the present invention may be applied to color negative films, color reversal films, color positive film, color photographic papers, color reversal photographic papers or a color diffusion transfer-system or silver dye bleaching system color photographic materials. The materials may also be applied to black and white photographic materials such as black and white photographic films, X-ray films, photo-engraving films, black and white photographic papers, aerial photographic films, microfilms, facsmimile films phototypesetting films, photographic papers, graphic films, etc.

Gelatins which may be used in the silver halide photographic materials of the present invention may be a so-called alkali-treated (or lime-treated gelatin), which is dipped in an alkaline bath, prior to the extraction of gelatin, in the manufacture procedure thereof, or an acid-treated gelatin, which is dipped in an acidic-bath, or a double-dipped gelatin, which is subject to said both alkali and acid treatments; or, it may also be an enzyme treated gelatin, as described in "Bull, Soc. Sci. Photo, Japan", No. 16, page 30 (1966). In addition, partially hydrolyzed gelatins having a low molecular weight obtained by heating the above-mentioned various kinds of gelatins in a hot-water bath or reacting those with protease may also be used in the present invention.

The above-described gelatins, to which the compounds of the present invention may be applied, may optionally be partially substituted by a collodial albumin, a casein, a cellulose derivative such as carboxymethylcellulose or hydroxyethylcellulose, an agar, a sodium alginate, a saccharide derivative such as starch derivative, a synthetic hydrophilic colloid such as polyvinyl alcohol, poly-N-vinylpyrrolidone, polyacrylic acid co-polymer or polyacrylamide, or a derivative thereof or a partially hydrolyzed product thereof. The compounds of the present invention may be applied to a partially substituted gelatin derivative obtained by modification of functional amino, imino, hydroxyl and/or carboxyl group(s) contained in the gelatin molecule with a reagent having one reactive group capable of reacting with the functional groups, or by a gelatin-graft polymer obtained by graft-polymerization of gelatin with other high molecular substance.

Examples of reagents which may be used for formation of said gelatin derivatives are, for example, isocyanates, acid chlorides, and acid anhydrides as described U.S. Pat. No. 2,614,928; acid anhydrides as described in U.S. Pat. No. 3,118,766; bromoacetic acids as described in Japanese Patent Publication No. 5514/64; phenylgylcidylethers as described in Japanaese Patent Publication No. 26845/67; vinylsulfone compounds as described in U.S. Pat. No. 3,132,945; N-aliylvinyl-sulfonamides as described in British Patent No. 861,414; malemide compounds as described in U.S. Pat. No. 3,186,846; acrylonitriles as described in U.S. Pat. No. 2,594,293; polyalkyleneoxides as described in U.S. Pat. No. 3,312,553; epoxy compounds as described in Japanese Patent Publication No. 26845/67; acid esters as described in U.S. Pat. No. 2,763,639; and alkanesultones as described in British Patent No. 1,033,189.

A number of high molecular weight substances which may be grafted with gelatin are described in U.S. Pat. Nos. 2,763,625, 2,831,767, and 2,956,884; *Polymer Letters*, Vol. 5, p. 595 (1967); *Phot. Sci. Eng.*, Vol. 9, p. 148 (1965); *J. Polymer Sci*, A-1, Vol. 9, p. 3199 (1971), etc. For example, polymers and copolymers of so-called vinyl monomers such as acrylic acid, methacrylic acid or an ester, amide or nitrile derivative thereof, or styrene, may be used for the graft-polymerization. In particular, hydrophilic vinyl polymers or copolymers which are somewhat compatible with gelatin are especially preferred, including polymers or copolymers of acrylic acid, acrylamide, methacrylamide, hydroxyalkyl acrylate, hydroxylalkyl methacrylate, etc.

The photographic materials of the present invention may optionally contain, in the photographic emulsion layers or other layers thereof, synthetic polymers other than the above-described polymers, such as a water-dispersible vinyl-polymer in the form of a latex. Especially preferably is a compound capable of increasing the dimensional stability of the photographic material singly or in the form of a mixture of said compounds, or, if necessary, in the form of a combination of said compound with other hydrophilic water-permeable colloid.

The photographic materials of the present invention may further contain matting agents. Fine particles of a water-insoluble organic or inorganic compound are preferred as matting agents, having an average diameter of from 0.2 to 10 um, and preferably from 0.3 to 5 um.

In the case wherein the photographically useful group-containing polymer used in the present invention is a yellow polymer-coupler, this coupler is in general incorporated in a blue-sensitive emulsion layer; in the case wherein the coupler is a magenta polymer coupler, it is generally incorporated in a green-sensitive emulsion layer; and in the case wherein the coupler is a cyan polymer-coupler, it is generally incorporated in a red-sensitive emulsion layer.

However, different combinations than those mentioned above may also be used, if desired. Couplers other than the polymer-couplers of the present invention may analogously be incorporated in an appropriate emulsion layer, if desired.

The couplers may be either 4-equivalent or 2-equivalent to silver ion. In addition, they may also be colored couplers having a color-correcting activity, or-so-called DIR-couplers which may release a development inhibitor during development.

Besides DIR couplers, non-coloring DIR-coupling compounds may be included, which may form a colorless reaction product after coupling and which may release a development inhibitor during development. Compounds other than DIR-couplers may also be used which may release a development inhibitor during development.

For introduction of the coupler in a silver halide emulsion layer in the present invention, a known method may be used, for example, as described in U.S. Pat. No. 2,322,027. For instance, the coupler incorporated in a silver halide emulsion layer is first dissolved in an alkyl phthalate (such as dibutyl phthalate, dioctyl phthalate), a phosphate (such as diphenyl phosphate, triphenyl phosphate, tricresyl phosphate, dioctylbutyl phosphate), a citrate (such as tributyl acetylcitrate), a benzoate (such as octyl benzoate), an alkylamide (such as diethyllaurylamide), a fatty acid ester (such as dibutoxyethyl succinate, diethyl azelate), a trimesate (such as tributyl trimesate); or in an organic solvent having a boiling point of about 30–150° C., for example, a lower alkyl acetate (such as ethyl acetate, butyl acetate), ethyl propionate, secondary butyl alcohol, methylisobutylketone, 8-ethoxyethyl acetate, methylcellosolve, etc. The resulting solution is dispersed in a hydrophilic colloid. The high boiling point-organic solvent and low boiling point-organic solvent may be used together in the form of a mixture.

Another dispersion method used for the introduction of the coupler into a polymer of the present invention is described in Japanese Patent Publication No. 39853/76 and Japanese Patent Application (OPI) No. 59943/76. If the coupler has an acid group such as a carboxylic acid or sulfonic acid group, the coupler may be introduced in a hydrophilic colloid in the form of an alkaline aqueous solution thereof.

The photographic emulsion layer of the photographic materials of the present invention may contain any silver halide selected-from silver bromide, silver bromoiodide, silver chloroiodide, silver bromochloride, and silver chloride.

The average particle size of silver halide particles in the photographic emulsion in the present invention is not specifically limitative, but is preferably 3$\mu$ or less. Regarding the average particle size of silver halide particles, in the case of particles that are spherical or nearly spherical, the diameter of the particle is measured on the basis of the projected area thereof, and in case the particles are cubical, the length of the side is the basis of the projected area thereof, and the size is designated by the average of the measured values.

The particle size distribution may be broad or narrow.

The silver halide particles in the photographic emulsion of the present invention may have a regular crystalline form such as a hexahedron or octahedron; or otherwise may have an irregular crystalline form such as a spherical or plate-like form; or may have a composite crystalline form comprising the combination of said regular and irregular forms.

An emulsion containing ultra-flat plate-like silver halide particles, in which the diameter of the particle is larger than the thickness thereof by 5 times or more, in a proportion of 50% or more of the total projected area, may also be used in the photographic materials of the present invention.

The silver halide particles of the present invention may have different inner phase and surface layer phase. The particles may form a latent image mainly on the surface parts thereof, or otherwise, may form the same mainly in the inner parts thereof.

The photographic emulsions to be used in the present invention may be prepared according to conventional methods as described in *Chimie et Physique Photographique*, by P. Glafkides, Paul Montel Co., (1967); *Photographic Emulsion Chemistry*, by G. F. Duffin, The Focal Press Co. (1966); or *Making and Coating Photographic Emulsion*, by V. L. Zelikman, et al., The Focal Press Co., (1964). The preparation of the present photographic emulsions may be carried out by any of acid method, neutral method, or ammonia method, according to said conventional means. In a reaction system where a soluble silver salt is reacted with a soluble halide, any conventional means such as one-side admixture method, simultaneous admixture method or a combination of said methods may be utilized.

A so-called reverse-admixture method may also be used, where silver halide particles are formed in the presence of an excess silver ion. As one embodiment of the simultaneous admixture method, a so-called controlled-double jet method may be used, where the pAg value in the liquid phase necessary to form silver halide particles is determined, and kept at the determined value. According to said method, a silver halide emulsion comprising particles having a regular crystalline form and a uniform particle size may be obtained.

Two or more kinds of silver halide emulsion which have been prepared seperately may be used together in the form of a mixture thereof.

During the formation of silver halide, particles or during the physical ripening step thereof, a cadmium salt, a zinc salt, a lead salt, a thallium salt, an iridium salt or a complex salt thereof, a rhodium salt or a complex salt thereof, or an iron salt or a complex salt thereof may co-exist in the reaction system.

Silver halide emulsions are in general chemical-sensitized. For the chemical-sensitization, for example, methods as described in *Die Grundiagender Pholographischen Processe mit Silberhalogeniden*, by H. Freiser, Akademische Verlagsgesellshaft, (1968), pp 675–734, may be used.

More precisely, a sulfur-sensitization method where a sulfur-containing compound capable of reacting with an active gelatin is used; a reductive sensitization method 10 using a reductive substance; and a noble metal-sensitization method using a noble metal compound may be used for the chemical-sensitization of the silver halide emulsions of the present invention, and said methods may be carried out singly or in the combination of two or more methods.

The photographic emulsions to be used in the present invention may additionally contain various kinds of additives, in order to prevent the photographic materials from being fogged during the manufacture thereof or during the preservation or photographic treatment thereof, or to stabilize the photographic characteristics of said materials.

For example, various kinds of conventional compounds which are known as anti-fogging agents or as stabilizers may be added to the present photographic emulsions, such as an azole compound, a mercaptopyrimidine compound, a mercaptotriazine compound, a thiocarbonyl compound, an azaindene compound, a thiosulfonic acid compund, a sulfinic acid compound, and a sulfonamide compound.

The photographic materials of the present invention may contain, in the photographic emulsion layer or in other hydrophilic colloid layer, a coating auxiliary agent and, various kinds of surfactants, for the purpose of static charge prevention, improvement of slide property, emulsification and dispersion, blocking inhibition, and improvement of photographic characteristics (e.g., development acceleration, high contrast reproduction, and sensitization).

For instance, various kinds of surfactants may be used for the purpose, including non-ionic surfactants such as saponins (steroid type), alkyleneoxide derivatives, glycidol derivatives, fatty acid esters of polyhydric alcohols and alkylesters of saccharides; anionic surfactants containing an acid group such as carboxyl group or sulfo group; ampholvtic surfactants such as aminoalkylsulfinic acid and alkylbetains; and cationic surfactants such as alkylamine salts and quaternary ammonium salts.

The photographic emulsion layer of the present photographic materials may further contain other additives for the purpose of increasing sensitivity and contrast, and for acceleration of development, including polyalkyleneoxides and ester, ether and amine derivatives thereof, and thioether compounds, thiomorpholines, quaternary ammonium salt compounds, urethane derivatives, urea derivatives, imidazole derivatives and pyrazolidone derivatives.

The present photographic materials may contain, in the photographic emulsion layers or in other hvdrophilic colloid layers, a dispersion of a synthetic polymer which is insoluble or slightly soluble in water. For example, polymers or copolymers of an alkyl(meth)acrylate and/or (meth) acrylamide and/or styrene, optionally with a (meth)acrylaic acid, hydroxyalkyl (meth)acrylate and/or styrenesulfonic acid, may used for this purpose.

The photographic emulsions to be used in the present invention may be spectral-sensitized by the use of methine dyes or the like other dyes. Examples of dyes which may be used for said spectral-sensitization are cyanine dyes, merocyanine dyes, complex cyanine dyes, complex merocyanine dyes, holopolar cyanine dyes, hemicyanine dyes, styryl dyes and hemioxonol dyes. Especially preferred dyes among them are cyanine dyes, merocyanine dyes and complex merocyanine dyes. These dyes may have any basic heterocyclic nucleus which is conventionally contained in cyanine dyes-, including pyrroline, oxazoline, thiazoline, pyrrole, oxazole, thiazole, selenazole, imidazole, tetrazole and pyridine nuclei; fused nuclei comprising said nucleus and an alicyclic hydrocarbon ring; and fused nuclei comprising said nucleus and an aromatic hydrocarbon ring, such as indolenine, benzindolenine, indole, benzoxazole, napthoxazole, benzothiazole, naphthothiazole, benzoselenazole, benzimidazole and quinoline nuclei. These nuclei may be substituted on carbon atoms.

Merocyanine dyes and complex merocyanine dyes may contain a ketomethylene structure-containing 5 or 6 membered heterocyclic ring nucleus such as pyrazolin-5-one, thiohydantoin, 2-thiooxazolidine-2,4-dione, thiazolidine-2, 4-dione, rhodanine, and thiobarbituric acid nuclei.

These sensitizing dyes may be used singly or in the form of a mixture thereof, and the use of a combination of sensitizing dyes is often preferred for the purpose of supersensitization.

The present photographic emulsion may further contain other dyes which themselves have no spectral-sensitization activity, or other substances which do not substantially absorb any visible radiation, but have supersensitization activity, together with the above-mentioned sensitizing dyes. For example, amino-styryl compounds which are substituted by an nitrogen-containing heterocyclic ring group (e.g., as described in U.S. Pat. Nos. 2,933,390 and 3,635,721); aromatic organic acid/formaldehyde condensation products (e.g., as described in U.S. Pat. No. 3,743,510); and cadmium salts and azaindene compounds may be added to the photographic emulsion for this purpose.

When the hydrophilic colloid layer in the photographic materials of the present invention contains dye-stuffs or ultraviolet absorbent, these may be mordanted by the use of a cationic polymer or the like.

The photographic materials of the present invention may contain as an anti-fogging agent, a hydroquinone derivative, an aminophenol derivative, a gallic acid derivative, or an ascorbic acid derivative. The photographic materials of the present invention may contain in the hydrophilic colloid layer thereof an ultra-violet absorbent. For example, aryl-substituted benzotriazole compounds (e.g., as described in U.S. Pat. No. 3,533,794); 4-thiazolidone compounds (e.g., as described in U.S. Pat. Nos. 3,314,794 and 3,352,681); benzophenone compounds (e.g., as described in Japanese Patent Application (OPI) No. 2784/71); cinnamate compounds (e.g., as described in U.S. Pat. Nos. 3,705,805 and 3,707,375); butadiene compounds (e.g. as described in U.S. Pat. No. 4,045,229); and benzooxazole compounds (compounds (e.g. as described in U.S. Pat. No. 3,700,455) may be used. In addition, UV absorbing coupler and UV absorbing polymers may also be used. The UV absorbents may be mordanted in a special layer if desired.

The photographic materials of the present invention may contain, in the hydrophilic colloid layer thereof, a water-soluble dye, as a filter dye, for the purpose of irradiation prevention, or for various other purposes. Such water-soluble dyes include oxonole dyes, hemioxonole dyes, styryl dyes, merocyanine dyes, cyanine dyes, and azo dyes. Oxonole dyes, hemioxonole dyes and merocyanine dyes are preferred.

The photographic materials of the present invention may additionally contain a known color-deterioration inhibitor or a color image-stabilizer which may be used singly or in a mixture of two or more kinds thereof. Conventional color-detefioration inhibitors which may be used in the present invention are, for example, hydroquinone derivatives (e.g., as described in Japanese Patent Application (OPI) No. 10539/84), gallic acid derivatives, p-alkoxyphenols and bisphenols.

For the photographic treatment of the photographic materials of the present invention may be utilized conventional means. In accordance with the object and the use of the photographic materials, any conventional photographic treatment may be applied thereto, such as a black and white photographic treatment for formation of silver images, or other photographic treatment for formation of color images (e.g., a color development system, diffusion transfer system, or silver dye bleaching system).

The developer to be used for said black and white photographic treatment may contain a conventional developing agent such as dihydroxybenzenes or aminophenols, and other conventional additives.

The color development system comprises steps of color development, silver bleaching and fixation (or bleach-fix); and the silver dye bleaching system comprises steps of black and white development, dye bleaching, silver-bleaching (or simultaneous dye and silver bleaching) and fixation.

A color developer used for said color development comprises, in general, an alkaline aqueous solution containing a color developing agent. Conventional aromatic primary amine developing agents such as phenylenediamines may be used. The color developer may additionally contain a pH buffer, an anti-fogging agent, a development inhibitor, a preservative, a development accelerator, a color forming coupler, a competing coupler, a fogging agent, and/or an auxiliary developing agent.

The silver bleaching treatment may be carried out together with the fixation treatment. As a silver bleaching agent, polyvalent metal compounds such as iron (III)-compounds, peroxides, and quinones may be used.

Any conventional fixing agent may be used in the fixation solution, for example, thiosulfates, thiocyanates and-organic sulfur-compounds may be used.

A PQ-type black and white developer is used, in general, in black and white development in the silver dye bleaching system.

In the dye-bleaching step, dyes are reduced and bleached by the use of a developed silver which has been formed in the photographic material and which acts as a catalyst. The dye-bleaching solution may contain an acid agent (such as mineral acid or an organic acid), a compound which may form a silver salt or a silver complex (such as potassium bromide or thiourea), and dye-bleaching accelerator catalyst (such as pyrazine, phenazine, or naphthoquinone).

The present invenion will be explained in greater detail by reference to the following examples, which, however, are not intended as limiting the scope of the present invention.

Procedure to Determine the % Wash-Out During RA4 Process:

Two-layer coatings on cellulose triacetate film support were prepared with the coverages for materials listed below.

Overcoat Layer:

125 mg/ft$^2$ gelatin 1.05 mg/ft$^2$ Alk-XC (surfactant)

0.394 mg/ft$^2$ FT-248 (surfactant)

4.9 mg/ft$^2$BVSME (hardener)

Bottom Layer:

125 mg/ft$^2$ gelatin 4 mg/ft$^2$ Alk-XC (surfactant)

2 mg/ft$^2$ Olin-10 G (surfactant)

polymer of this invention at the coverage of 0.2 mmole/ft$^2$ of UV chromophore

The coatings containing various water soluble polymers were treated with Kodak RA4 processing. The absorption spectra of each sample before and after the treatment were collected by Perkin-Elmer Lambda 4B spectrophotometer. The ratio of the absorbance at 345 nm before and after the RA4 process are calculated. The % wash-out is then calculated based on this number.

| Composition | Wt % | Notebook | % wash-out | Remark |
|---|---|---|---|---|
| UV-10:Aa:Wn | 60/23/17 | BB4920-153 | 81.4% | comparison |
| UV-10/Aa/Wn | 52/20/28 | BB5679-01 | 83.5 | comparison |
| UV-10/Aa/Wn | 50/9/41 | BB5679-02 | 82.8 | comparison |
| UV-10/Am/Wn | 60.7/22.7/16.6 | BB4920-155 | 81.7 | comparison |
| UV-10/Am/Ga/Wn | 50/37.5/2.5/10 | BB5679-14 | 28 | comparison |
| UV-10/Am/Ga/Wn | 50/35/5/10 | BB5679-15 | 21 | comparison |
| UV-10/Am/Wn | 50/35/15 | BB5679-11 | 83.0 | comparison |
| UV-2/Am/Wn | 50/40/10 | BB5679-18 | 78.6 | comparison |
| UV-10/Am/Imz/Wn | 50/37.5/2.5/10 | BB5679-16 | 0.4 | Invention |
| UV-2/Am/Imz/Wn | 50/37.5/2.5/10 | BB5679-35 | 0 | Invention |
| UV-7/Am/Imz/Wn | 50/37.5/2.5/10 | BB5679-38 | 2.48 | Invention |
| UV-7/Am/Imz/Wn(50) UV-9/Am/Imz/Wn(50) | 50/37.5/2.5/10 | BB5679-38 and −40 | 2.59 | Invention |
| UV-7/Am/Imz/Wn(75) UV-9/Am/Imz/Wn(25) | 50/37.5/2.5/10 | BB5679-38 and −40 | 1.68 | Invention |

It is clear from the table above that water-soluble polymeric UV absorbers containing 2-vinylimidazole(Imz) group remained on the film after the process, while other water-soluble polymers(except polymers containng epoxide functional group) almost compleletly washed-out during the process.

The invention has been described in detail with particular reference to certain preferred embodiments thereof, but it will be understood that variations and modifications can be effected within the spirit and scope of the invention.

We claim:

1. A silver halide photographic material comprising at least one layer which contains;

a) a water soluble polymer consisting of as constituent components thereof a repeating unit derived from an ethylenically unsaturated monomer having a photographically useful group selected from the group consisting of a photo graphic dye, a development inhibitor, a development accelerator, a coupler, a competing coupler, a development inhibitor-releasing compound, a developing agent, a development auxiliary bleaching inhibitor, a bleach accelerator, a bleaching accelerator-releasing compound, a silver halide solvent, a silver complexing agent, a fogging agent, an antifogging agent, a desensitizer, an ultraviolet absorber, an antioxidant, a development accelerator-releasing compound and precursors thereof, at least one repeating unit derived from an ethylenically unsaturated monomer having an imidazole group; and an additional monomer selected from the group consisting of sodium vinyl sulfonate, 3-sulfopropyl methacrylate, 3-sulfopropylacrylate (hydrogen, sodium or potassium salt), 2-sulfoethylmethacrylate (hydrogen, sodium or potassium salt), 2-sulfoethylacrylate (hydrogen, sodium or potassium salt), 2-acrylamido-2-methyl-1-propanesulfonic acid (hydrogen, sodium or potassium salt), 1-vinyl-2-pyrrolidinone, acrylic acid, methacrylic acid, vinyl benzene sulfonate (hydrogen, sodium or potassium salt), and vinyl phosphoric acid;

b) a compound having at least one functional group which reacts with an imidazole group and at least one other functional group capable of reacting with an imidazole group and a primary amine group, the amount of compound (b) being sufficient to insure adequate fixation of said polymer.

2. The silver halide photographic material of claim 1 wherein said layer contains gelatin.

3. The silver halide material of claim 1, wherein said repeating unit having a photographically useful group in said polymer is represented by formula (A)

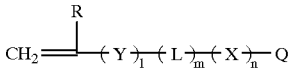

wherein;

R is hydrogen atom or an alkyl group having from 1 to 6 carbon atoms;

Y is

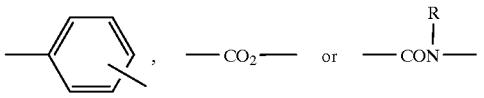

wherein R has the same meaning as above;

L is a divalent bonding group having from 1 to 12 carbon atoms;

X is

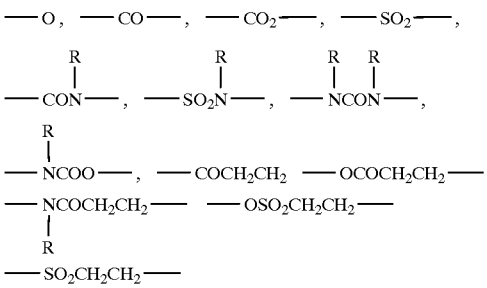

wherein R has the same meaning as above;

Q is a photographically useful group; and l, m, and n are each independently 0 or 1.

4. The silver halide photographic material of claim 3 wherein L in said formula (A) represents an alkylene group, an arylene group or a group represented by the formula

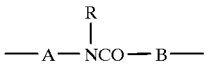

or —A—$CO_2$—B— in which R is a hydrogen atom or an alkyl group having from 1 to 6 carbon atoms, and A and B each represents an alkylene group having from 1 to 10 carbon atoms or an arylene group having from 6 to 10 carbon atoms, and said alkylene group and arylene group substituted by at least one member selected from the group consisting of an aryl group, a nitro group, a hydroxyl group, a cyano group, an alkoxy group, an aryloxy group, an alkylcarbonyloxy group, an arylcarbonyloxy group, an alkylcarbonylamino group, an arylcarbonylamino group, a carbamoyl group, an alkylcarbamoyl group, a dialkylcarbamoyl, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an arylsulfamoyl group, carboxyl group, an alkoxycarbonyl group, and a halogen atom.

5. The silver halide photographic material of claim 3 wherein Q in said formula (A) represents a cyan coupler group of Formula (I)-1 or (I)-2

(I)-1

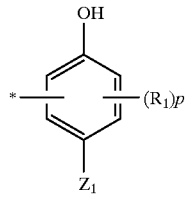

(I)-2

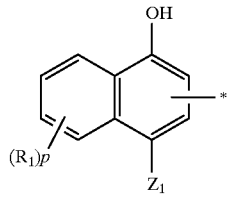

wherein the asterisk mark * show the position of the bond to X;

$R_1$ represents an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group or an arylureido group;

p is an integer of 0 to 3, and q is an integer of 0 to 4;

$Z_1$ represents hydrogen atom, a halogen atom, a sulfo group, an acyloxy group, an alkoxy group, an aryloxy group, a heterocyclic oxy group, an alkylthio group, an arylthio group or a heterocyclic thio group and these groups are substituted by at least one member selected from the group consisting of an aryl group, a nitro group, hydroxy group, cyano group, sulfo group, an alkoxy group, an aryloxy group, an acyloxy group, an acylamino group, an alkylsulfonamido group, an alkylsulfamoyl group, carboxyl group, an alkylcarbamoyl group, an alkoxycarbonyl group, an alkylsulfonyl group, and an alkylthio group.

6. The silver halide photographic material of claim 3 wherein Q in said formula (A) represents a magenta coupler group of one of Formula (I)-3 or (I)-14

(I)-3

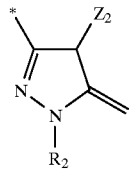

(I)-4

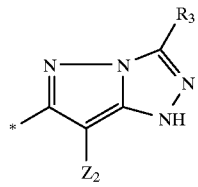

-continued (I)-5

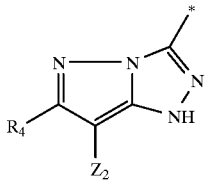

(I)-6

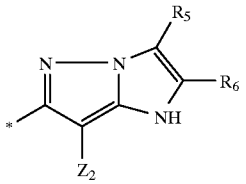

(I)-7

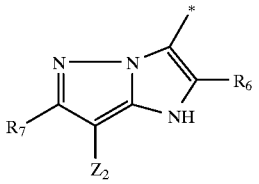

(I)-8

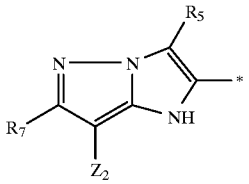

(I)-9

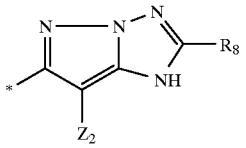

(I)-10

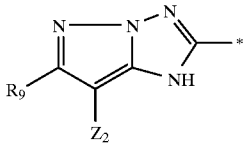

(I)-11

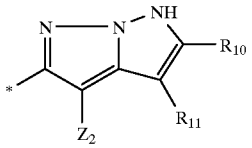

(I)-12

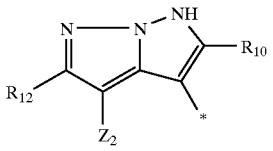

-continued (I)-13

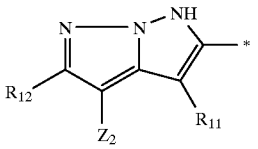

(I)-14

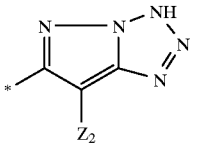

wherein the asterisk mark * shows the position of the bond to X;

$R_2$ represents an alkyl group, a substituted alkyl group, an aryl group, a substituted aryl group, an alkoxy group, an aryloxy group, an alkoxycarbonyl group, an acylamino group, a carbamoyl group, an alkylcarbamoyl group, a dialkylcarbmoyl group, an arylcarbamoyl group, an alkylsulfonyl group, an aryisulfonyl group, an alkylsulfonamido group, an arylsulfonamido group, a sulfamoyl group, an alkylsulfamoyl group, a dialkylsulfamoyl group, an arylsulfamoyl group, an alkylthio group, an arylthio group, cyano group, nitro group, and a halogen atom;

$R_3$, $R_4$, $R_5$, $R_6$, $R_7$, $R_8$, $R_9$, $R_{10}$, $R_{11}$ and $R_{12}$ each independently represents a hydrogen atom, a hydroxyl group, or a substituted or unsubstituted alkyl group, an aryl group, a heterocyclic group, an alkylamino group, an acylamino group, an anilino group, an alkoxycarbonyl group, an alkylcarbonyl group, an arylcarbonyl group, an alkylthio group, an arylthio group, a carbamoyl group, a sulfamoyl group, an alkyl sulfonamido group, or an arylsulfonamido group; and $Z_2$ represents a hydrogen atom, a halogen atom, or a split-off group which is bonded at a coupling position via an oxygen, nitrogen, or sulfur atom.

7. The silver halide photographic material of claim 3 wherein Q in said formula (A) represents a yellow coupler group of one of Formula (I)-15 through (I)-17

(I)-15

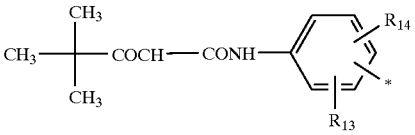

(I)-16

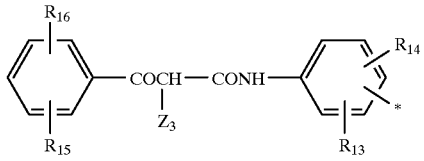

-continued (I)-17

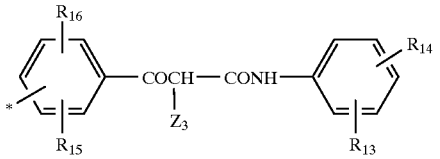

wherein the asterisk mark * show the position of the bond to X;

$R_{13}$, $R_{14}$, $R_{15}$ and $R_{16}$ each independently represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylfonamido group, an alkylureido group, an alkyl-substituted succinmido group, an aryloxy group, an aryloxycarbonyl group, an arylcarbamoyl group, an arylamido group, an arylsulfamoyl group, an arylsulfonamido group, an arylureido group, a carboxyl group, a sulfo group, a nitro group, a cyano group or a thiocyano group;

$Z_3$ represents a hydrogen atom, —$OR_{17}$ wherein $R_{17}$ represents an aryl group, a substituted aryl group or a heterocyclic group, or a group represented by one of the formulae,

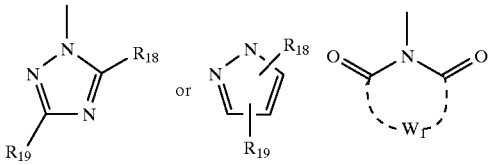

wherein $R_{18}$ and $R_{19}$ each independently represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, a substituted or unsubstituted phenyl group, or a heterocyclic ring, and $W_1$ represents an atomic group forming a 4 to 7 membered ring together with

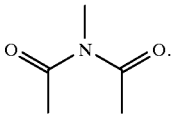

8. The silver halide photographic material of claim 7 wherein $Z_3$ in said formulae (I)-15 through (I)-17 represents

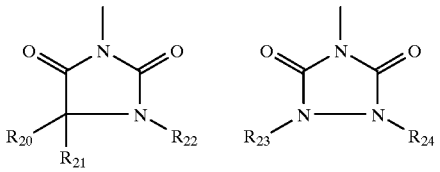

-continued

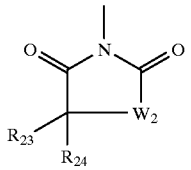

wherein $R_{20}$, $R_{21}$, and $R_{22}$ each independently represents a hydrogen atom, an alkyl group, an aryl group, an aralkyl group, or an acyl group; $W_2$ represents an oxygen atom or a sulfur atom; $R_{23}$ and $R_{24}$ each independently represents a hydrogen atom, an alkyl group, an aryl group, an alkoxy group, an aryloxy group, or hydroxy group.

9. The silver halide photographic material of claim 3, wherein Q in said formula (A) represents a development inhibitor group of one of Formulae (II)-1 through (II)-6

(II)-1

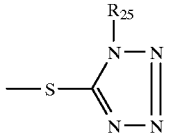

(II)-2

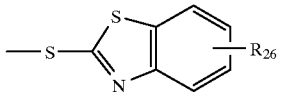

(II)-3

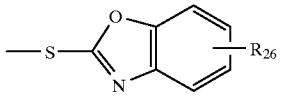

(II)-4

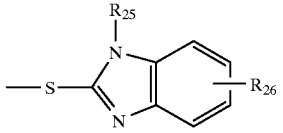

(II)-5

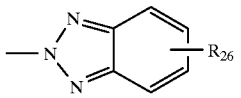

(II)-6

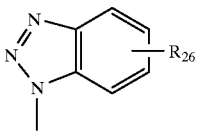

wherein $R_{25}$ represents a hydrogen atom, an alkyl group containing from 1 to 6 carbon atoms, a phenyl group, or a substituted phenyl group; and $R_{26}$ represents hydrogen atom, a halogen atom, an alkyl group containing from 1 to 4 carbon atoms, or a nitro group.

10. The silver halide photographic material of claim 3, wherein Q in said formula (A) represents a developing agent group of one of formulae (III)-1 through (III)-6

(III)-1

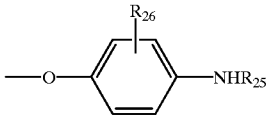

(III)-2

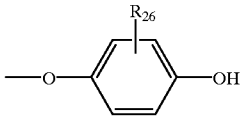

(III)-3

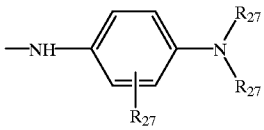

(III)-4

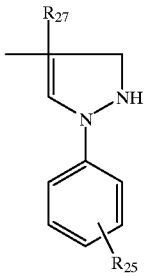

(III)-5

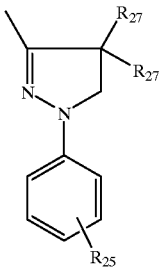

(III)-6

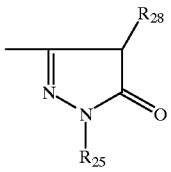

wherein $R_{25}$ represents a hydrogen atom, an alkyl group containing from 1 to 6 carbon atoms, a phenyl group, or a substituted phenyl group; $R_{26}$ represents hydrogen atom, a halogen atom, an alkyl group containing from 1 to 4 carbon atoms, or a nitro group; $R_{27}$ represents a hydrogen atom, an alkyl group containing 1 to 4 carbon atoms, a hydroxyalkyl group containing from 1 to 4 carbon atoms or a sulfoalkyl group containing from 1 to 4 carbon atoms; and $R_{28}$ represents an alkyl group containing from 1 to 20 carbon atoms or an aryl group containing 6 to 20 carbon atoms.

11. The silver halide photographic material of claim 3, wherein Q in said formula (A) represents a bleaching inhibitor group of one of formulae (IV)-1 through (IV)-4

(IV)-1

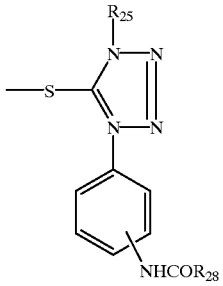

(IV)-2

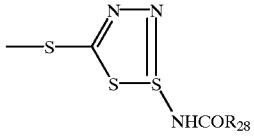

(IV)-3

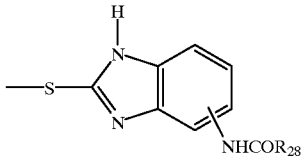

(IV)-4

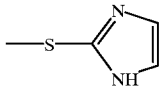

wherein $R_{28}$ represents an alkyl group containing from 1 to 20 carbon atoms or an aryl group containing 6 to 20 carbon atoms.

12. The silver halide photographic material of claim 3 wherein Q in said formula (A) represents an ultra-violet absorbent group of one of formulae (V)-1 through (V)-8

(V)-1

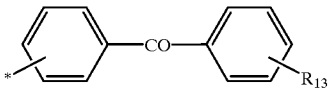

(V)-2

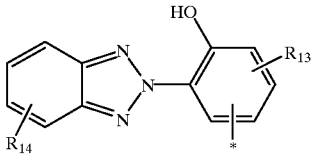

(V)-3

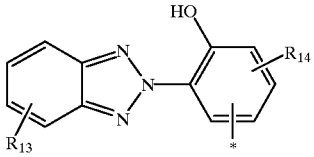

-continued (V)-4

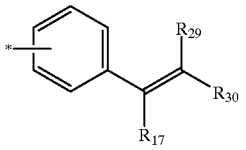

(V)-5

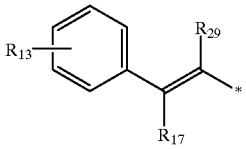

(V)-6

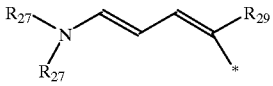

(V)-7

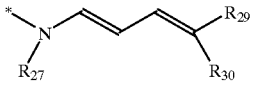

(V)-8

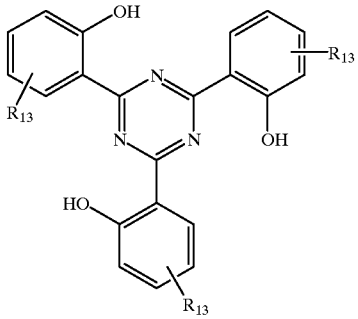

wherein $R_{13}$ and $R_{14}$ each independently represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsfonamido group, an alkylureido group, an alkyl-substituted succinmido group, an aryloxy group, an aryloxycarbonyl group, an arylcarbamoyl group, an arylamido group, an arylsulfamoyl group, an arylsulfonamido group, an arylureido group, a carboxyl group, a sulfo group, a nitro group, a cyano group or a thiocyano group; $R_{17}$ represents an aryl group, a substituted aryl group or a heterocyclic group; $R_{27}$ represents a hydrogen atom, an alkyl group containing 1 to 4 carbon atoms, a hydroxyalkyl group containing from 1 to 4 carbon atoms or a sulfoalkyl group containing from 1 to 4 carbon atoms; and $R_{29}$ and $R_{30}$ each independently represents a cyano group, an aryl group, an alkyl group, an alkoxycarbonyl group, an arylsulfonyl group, or an alkylsulfonyl group.

13. The silver halide photographic material of claim 3 wherein Q in said formula (A) represents a group derived from a triarylmethane-type, azo-type, anthraquinone-type, merocyanine-type, oxonole-type, arylidene-type or styryl-type dye.

14. The silver halide photographic material of claim 1, wherein said repeating unit having an imidazole group is represented by a general formula (B):

(B)

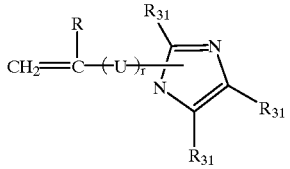

wherein R is a hydrogen atom or an alkyl group having from 1 to 6 carbon atoms; U represents a divalent bonding group containing from 1 to 20 carbon atoms; r is 0 or 1; $R_{31}$ represents hydrogen, a primary alkyl group, a secondary alkyl group, a tertiary alkyl group, an aryl group, and an arylalkyl group.

15. The silver halide material of claim 14, wherein U in said formula (B) represents an alkylene group, a phenylene group, an arylene-alkylene group, —$CO_2$—, —$CO_2$—$R_{30}$—, —CONH—$R_{30}$—, or —CONR—$R_{30}$— wherein $R_{30}$ represents an alkylene group, a phenylene group or an arylenealkylene group.

16. The silver halide photographic material of claim 1 wherein said repeating unit having an imidazole group is selected from the group consisting of formulae Imz-1 through Imz-22 below;

Imz-1

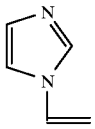

Imz-2

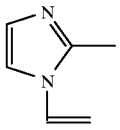

Imz-3

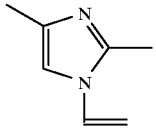

Imz-4

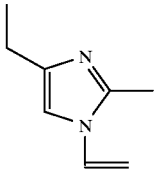

Imz-5

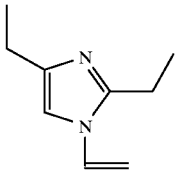

-continued
Imz-6
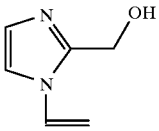
Imz-7
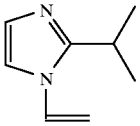
Imz-8
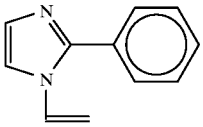
Imz-9
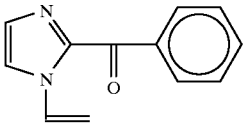
Imz-10
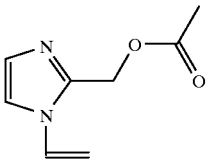
Imz-11
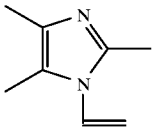
Imz-12
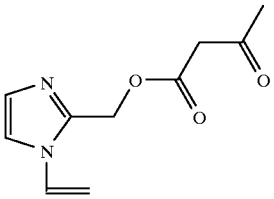
Imz-13
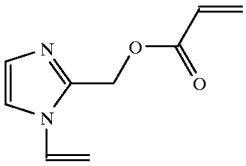
Imz-14
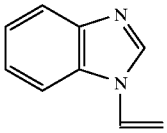
-continued
Imz-15
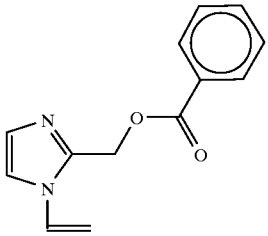
Imz-16
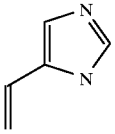
Imz-17
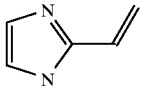
Imz-18
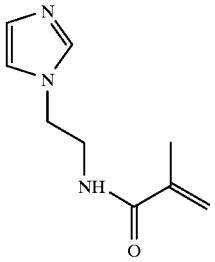
Imz-19
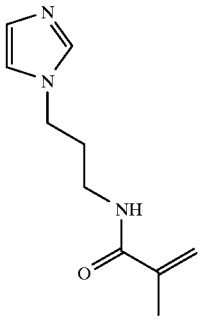
Imz-20
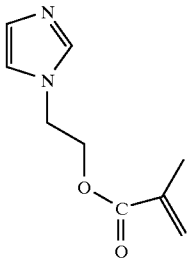

-continued

Imz-21

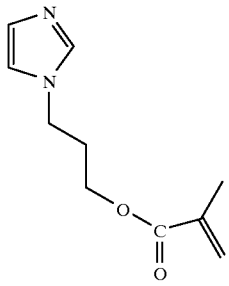

and

Imz-22

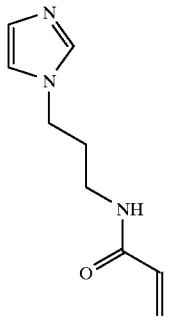

Imz-22

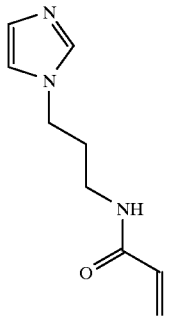

17. The silver halide photographic material of claim 1 wherein said layer comprises a silver halide emulsion layer, a protective layer or a subbing layer.

18. The silver halide photographic material of claim 1 wherein the amount compound (b) is from 0.05 to 10 molar times the amount of the imidazole group contained in the polymer.

19. The silver halide photographic material of claim 17 wherein the content of the photographically useful group is form 20 to 98 wt. %, the content of the imidazole group containing monomer is from 2 to 50 wt. %, and the content of the other repeating group is 70 wt. % or less.

20. The silver halide photographic material of claim 1 wherein the polymer containing photographically useful groups of the present invention have a molecular weight of from $5\times10^3$ to $1\times10^7$.

21. The silver halide photographic material of claim 1 wherein said compound (b) is a photographic gelatin hardening agent.

22. The silver halide photographic material of claim 21 wherein said photographic gelatin hardening agent is selected from the group consisting of aldehydes, ketones, N-methylol compounds, dioxane derivatives, active vinyl compounds, active esters, active halogen compounds, mucohalogenic acids, isoxazoles, dialdehyde-starchs, and 1-chloro-6-hydroxytriazinylated gelatins.

23. The silver halide photographic material of claim 22 wherein said gelatin hardening agent is selected from vinylsulfonyl compounds and precusors thereof represented by formulae (C) and (D)

$$CH_2{=}CHSO_2{-}A{-}SO_2CH{=}CH_2 \quad (C)$$

$$XCH_2{-}CH_2SO_2{-}A{-}SO_2CH_2{-}CH_2X \quad (D)$$

wherein A represents a divalent bonding group; X represents a mono-valent organic group which may be removed from formula (D) in the form of a compound of HX to form a compound of formula (C).

24. The silver halide photographic material of claim 23, wherein A in said formulae (C) and (D) represents an alkylene group, a phenylene group, an alkylene group containing an ether bond or an amido bond in the chain thereof.

25. The silver halide photographic material of claim 22 wherein X represents hologen atom, an alkoxy group, a sulfonyloxy group or an alkylsulfonyloxy group.

* * * * *